US011049471B2

(12) United States Patent
Yang et al.

(10) Patent No.: US 11,049,471 B2
(45) Date of Patent: Jun. 29, 2021

(54) DISPLAY CONTROL CIRCUIT

(71) Applicant: NOVATEK MICROELECTRONICS CORP., HsinChu (TW)

(72) Inventors: Jun-Yu Yang, Hsinchu (TW); Shang-Yu Su, New Taipei (TW); Feng-Ting Pai, Hsinchu (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

(21) Appl. No.: 16/524,264

(22) Filed: Jul. 29, 2019

(65) Prior Publication Data

US 2021/0035526 A1 Feb. 4, 2021

(51) Int. Cl.
*G09G 5/02* (2006.01)

(52) U.S. Cl.
CPC ..... *G09G 5/02* (2013.01); *G09G 2320/0666* (2013.01); *G09G 2320/0686* (2013.01)

(58) Field of Classification Search
CPC ..... G09G 5/02; G09G 2340/0457; G09G 2320/0666; G09G 2320/0686; G09G 2300/0439; G09G 3/3607
See application file for complete search history.

(56) References Cited

U.S. PATENT DOCUMENTS 8,508,548 B2 * 8/2013 Brown Elliott ..... G09G 3/2003 345/613

* cited by examiner

*Primary Examiner* — Antonio A Caschera
(74) *Attorney, Agent, or Firm* — McClure, Qualey & Rodack, LLP

(57) ABSTRACT

A display control circuit transforms a plurality of input points of an input image to a plurality of target subpixels of a display panel. In the display panel, a first row of the target subpixels and a second row of the target subpixels are non-aligned in a vertical direction. The display control circuit includes a subpixel rendering circuit. The subpixel rendering circuit maps a first row of the input points to the first row of the target subpixels, and maps a second row of the input points to the second row of the target subpixels. The coordinates of the first row of the input points are respectively equivalent to the coordinates of the first row of the target subpixels. The coordinates of the second row of the input points are respectively equivalent to the coordinates of the second row of the target subpixels being shifted in a horizontal direction.

9 Claims, 20 Drawing Sheets

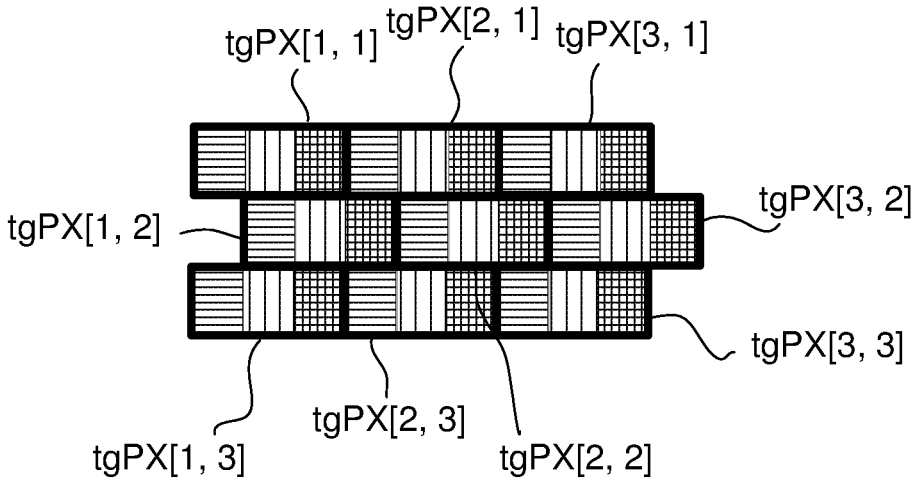
FIG. 10
FMx_c1
$$\begin{pmatrix} 0 & 0 & 0 \\ 0 & 1 & 0 \\ 0 & 0 & 0 \end{pmatrix}$$
FMx_c2
$$\begin{pmatrix} 0 & 0 & 0 \\ 0 & 1 & 0 \\ 0 & 0 & 0 \end{pmatrix}$$
FMx_c3
$$\begin{pmatrix} 0 & 0 & 0 \\ 0 & 1 & 0 \\ 0 & 0 & 0 \end{pmatrix}$$
FIG. 11A
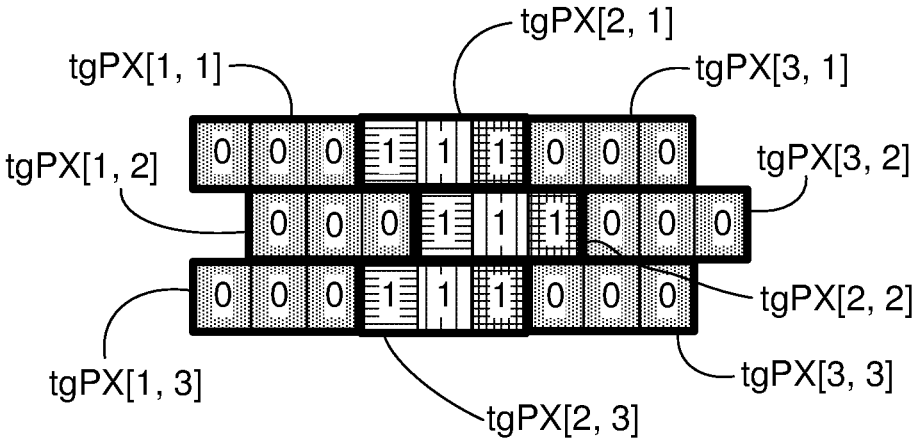
FIG. 11B inDS{1, 1}_c1

$$\begin{bmatrix} 0 & 0 & 3 \\ 0 & 0 & 3 \\ 0 & 0 & 3 \end{bmatrix}$$

inDS{2, 1}_c1

$$\begin{bmatrix} 0 & 3 & 0 \\ 0 & 3 & 0 \\ 0 & 3 & 0 \end{bmatrix}$$

inDS{2, 2}_c1

$$\begin{bmatrix} 0 & 3 & 0 \\ 0 & 3 & 0 \\ 0 & 3 & 0 \end{bmatrix}$$

inDS{3, 2}_c1

$$\begin{bmatrix} 3 & 0 & 0 \\ 3 & 0 & 0 \\ 3 & 0 & 0 \end{bmatrix}$$

inDS{1, 3}_c1

$$\begin{bmatrix} 0 & 0 & 3 \\ 0 & 0 & 3 \\ 0 & 0 & 3 \end{bmatrix}$$

inDS{2, 3}_c1

$$\begin{bmatrix} 0 & 3 & 0 \\ 0 & 3 & 0 \\ 0 & 3 & 0 \end{bmatrix}$$

FMx{1, 1}_c1

$$\frac{1}{3} \cdot \begin{bmatrix} 0 & 0 & 0 \\ 1 & 2 & 0 \\ 0 & 0 & 0 \end{bmatrix}$$

FMx{2, 1}_c1

$$\frac{1}{3} \cdot \begin{bmatrix} 0 & 0 & 0 \\ 0 & 2 & 1 \\ 0 & 0 & 0 \end{bmatrix}$$

FMx{2, 2}_c1

$$\frac{1}{3} \cdot \begin{bmatrix} 0 & 0 & 0 \\ 1 & 2 & 0 \\ 0 & 0 & 0 \end{bmatrix}$$

FMx{3, 2}_c1

$$\frac{1}{3} \cdot \begin{bmatrix} 0 & 0 & 0 \\ 0 & 2 & 1 \\ 0 & 0 & 0 \end{bmatrix}$$

FMx{1, 3}_c1

$$\frac{1}{3} \cdot \begin{bmatrix} 0 & 0 & 0 \\ 1 & 2 & 0 \\ 0 & 0 & 0 \end{bmatrix}$$

FMx{2, 3}_c1

$$\frac{1}{3} \cdot \begin{bmatrix} 0 & 0 & 0 \\ 0 & 2 & 1 \\ 0 & 0 & 0 \end{bmatrix}$$

FIG. 23A

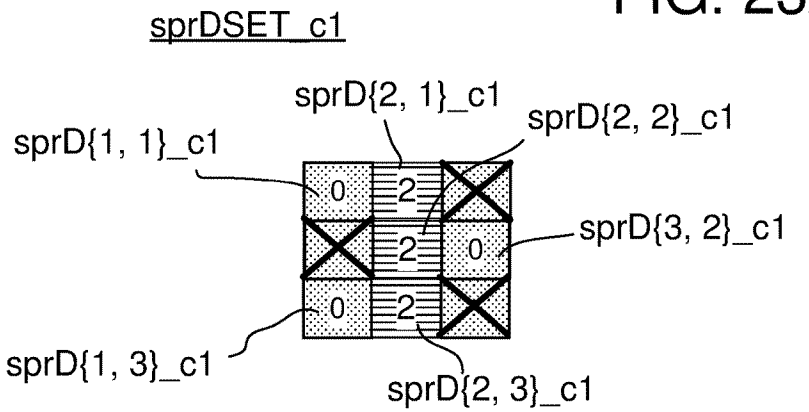

FIG. 23B

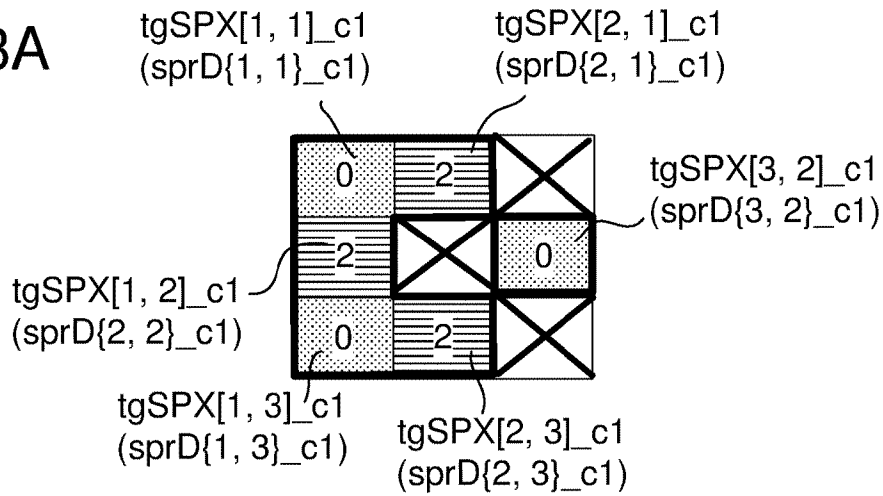

FIG. 23C

DISPLAY CONTROL CIRCUIT

TECHNICAL FIELD

The disclosure relates in general to a display control circuit and a display device, and more particularly to a display control circuit and a display device capable of improving the display quality of the display panels with various subpixel layout.

BACKGROUND

Nowadays, many display devices such as laptops or mobiles are equipped with display panels. The display panels are used together with display control circuits, for transforming input images IMGin into controlling signals suitable for the display panels.

FIG. 1 is a schematic diagram illustrating an input image IMGin to be displayed on a display panel. The input image IMGin can be considered as a matrix of input points (inPT). The input points (inPT) in the input image IMGin are arranged in Min columns and Nin rows, and each colored input point (inPT) includes multiple colored input points (inPT_c1, inPT_c2, inPT_c3).

In display systems, R-G-B representation is widely used. Usually, the input image IMGin can be separated into three color-planes, a red color-plane (IMGin_c1), a green color-plane (IMGin_c2), and a blue color-plane (IMGin_c3). In the specification, the color red (c1) is represented by horizontal screentone, the color green (c2) is represented by vertical screentone, and the color blue (c3) is represented by grid screentone. Although the illustrations are based on the R-G-B representation, the application of the present disclosure is not limited to the R-G-B representation.

FIG. 2 is a schematic diagram illustrating subpixels being mounted on a conventional display panel. Pixels PX mounted on a conventional display panel 12 are arranged in Mdp columns and Ndp rows, and each pixel PX includes a red subpixel (SPX_c1), a green subpixel (SPX_c2), and a blue subpixel (SPX_c3).

Because the resolution of the input image (IMGin) is usually different from the resolution of various display panels, a subpixel rendering circuit is used by the display control circuit. The subpixel rendering circuit adjusts the apparent resolution of the display panel by rendering pixels to take into account the physical properties of the display panel. As the display panels may have various pixel layout, the subpixel rendering circuit needs to consider the physical layout of the pixels.

SUMMARY

The disclosure is directed to a display control circuit and a display device. The display control circuit is used together with a display panel in the display device.

According to another embodiment, a display control circuit for controlling a display panel is provided. The display panel includes a plurality of first colored subpixels in a target region. The display control circuit includes a subpixel rendering circuit. The subpixel rendering circuit converts a plurality of first colored input points in a first selected region to a plurality of first rendered subpixel data corresponding to the plurality of first colored subpixels. The first selected region includes a first core area and a first boundary area. Layout of the plurality of first colored input points in the first core area and layout of the first colored subpixel are inconsistent.

According to an alternative embodiment, a display device including a display panel and a display control circuit is provided. The display panel includes a plurality of first colored subpixels in a target region. The display control circuit controls the display panel. The display control circuit includes a subpixel rendering circuit. The subpixel rendering circuit converts a plurality of first colored input points in a first selected region to a plurality of first rendered subpixel data corresponding to the plurality of first colored subpixels. The first selected region includes a first core area and a first boundary area. Layout of the plurality of first colored input points in the first core area and layout of the first colored subpixel are inconsistent.

BRIEF DESCRIPTION OF THE DRAWINGS

FIG. 10 is a schematic diagram illustrating the target region of a display panel having staggered subpixel layout.

FIG. 11A is a schematic diagram illustrating a scenario that the red filter kernel FMx_c1, the green filter kernel FMx_c2, and the blue filter kernel FMx_c3 have identical rendering filter coefficients.

FIG. 11B is a schematic diagram illustrating that the target subpixels tgSPX in FIG. 10 displaying the rendered subpixel data being generated based on the direct mapping approach.

FIGS. 23A, 23B, and 23C are schematic diagrams illustrating the generation of the red rendered subpixel data set sprDSET_c1 and mapping the red rendered subpixel data to the red target subpixels tgSPX[a, b]_c1 according to the embodiment of the present disclosure.

Figure 1:
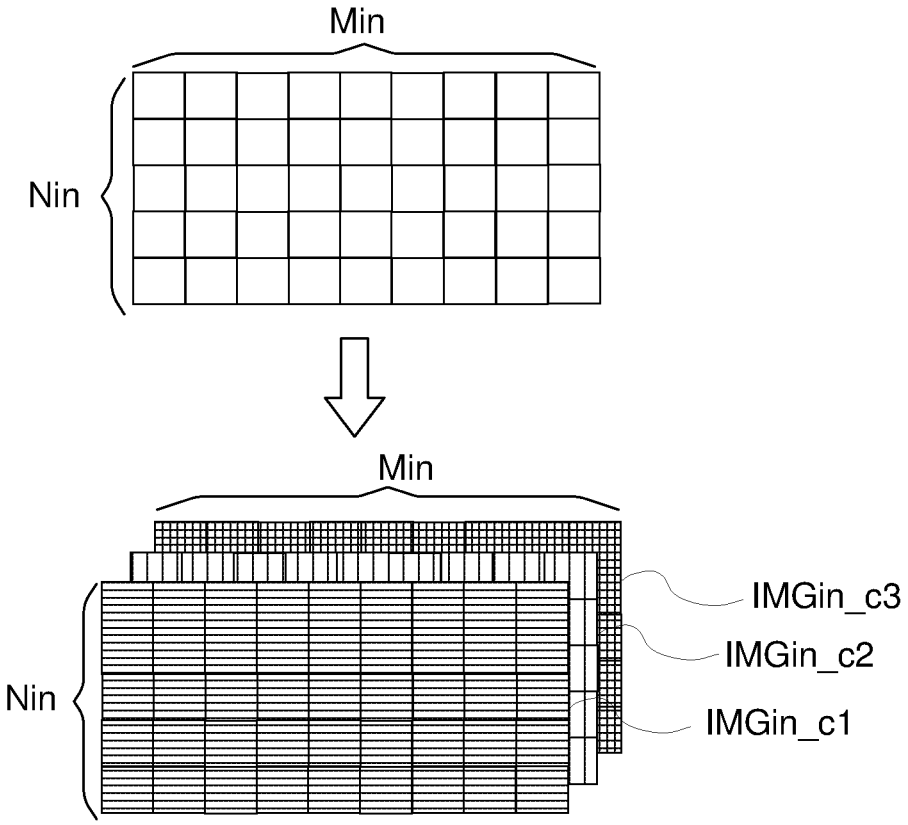
FIG. 1 (PRIOR ART)
FIG. 1 (prior art) is a schematic diagram illustrating an input image IMGin to be displayed on a display panel.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Figure 3:
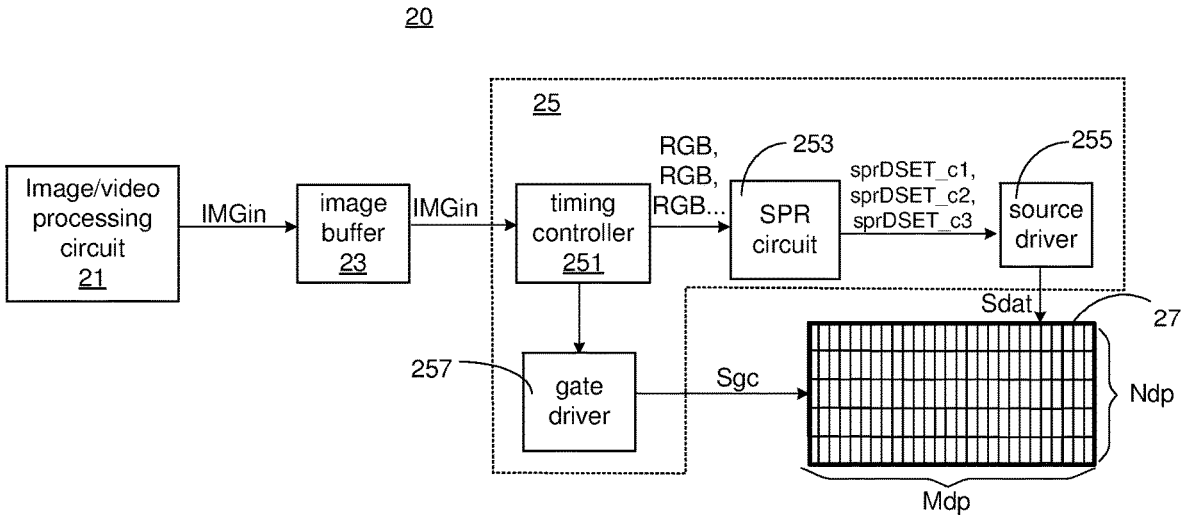
FIG. 3 is a block diagram of a display device equipped with a display control circuit and a display panel.

FIG. 3 is a block diagram of a display device equipped with a display control circuit and a display panel. The display device 20 includes an image/video processing circuit 21 (for example, a video decoder), an image buffer 23 (for example, a memory), a display control circuit 25, and a display panel 27. The image buffer 23 is electrically connected to the image/video processing circuit 21 and the display control circuit 25, and the display panel 27 is electrically connected to the display control circuit 25.

Pixels mounted on the display panel 27 are arranged in Mdp columns and Ndp rows, and each pixel PX includes a red subpixel (SPX_c1), a green subpixel (SPX_c2), and a blue subpixel (SPX_c3). For the sake of illustration, sizes of the different colored subpixels are assumed to be equivalent in the specification. Whereas, the SPR circuit 253 can also be applied to the display panels whose subpixels may have different sizes.

The display control circuit 25 further includes a timing controller 251, a subpixel rendering circuit (hereinafter, SPR) 253, a source driver 255, and a gate driver 257. The timing controller 251 is electrically connected to the image buffer 23, the SPR circuit 253, and the gate driver 257, and the source driver 255 is electrically connected to the SPR circuit 253 and the display panel 27.

The image/video processing circuit 21 generates an input image IMGin, which can be temporarily stored at the image buffer 23 or directly transmitted to the timing controller 251. Then, the timing controller 251 decomposes input image IMGin into sequences of colored input points (inPT_c1, inPT_c2, inPT_c3) and transmits color values CV of the colored input points (inPT_c1, inPT_c2, inPT_c3) to the SPR circuit 253 in sequence (R-G-B-R-G-B . . . and so forth). The color values CV can be ranged from 0 to 255.

Then, the SPR circuit 253 transforms color values CV of the colored input points (inPT_c1, inPT_c2, inPT_c3) to three rendered subpixel data sets sprDSET_c1, sprDSET_c2, sprDSET_c3. Later, the source driver 255 generates and transmits data signals Sdat based on the rendered subpixel data sets sprDSET_c1, sprDSET_c2, sprDSET_c3 to the display panel 27. The brightness of the subpixels in the display panel is determined by the data signals Sdat. The data signals Sdat representing the rendered subpixel data sets sprDSET_c1, sprDSET_c2, sprDSET_c3 are transmitted to the display panel in a row-by-row manner. Besides, the timing controller 251 generates timing related signals to the gate driver 257 so that the gate driver 257 can generate gate control signals Sgc accordingly. The gate control signals Sgc are further transmitted to the display panel 27.

In the display control circuit 25, the timing controller 251, the SPR circuit 253, and the source driver 255 are related to the generation of data signals Sdat. According to the embodiment of the present disclosure, the implementations of the timing controller 251, the SPR circuit 253, and the source driver 255 are not limited.

Figure 4A:
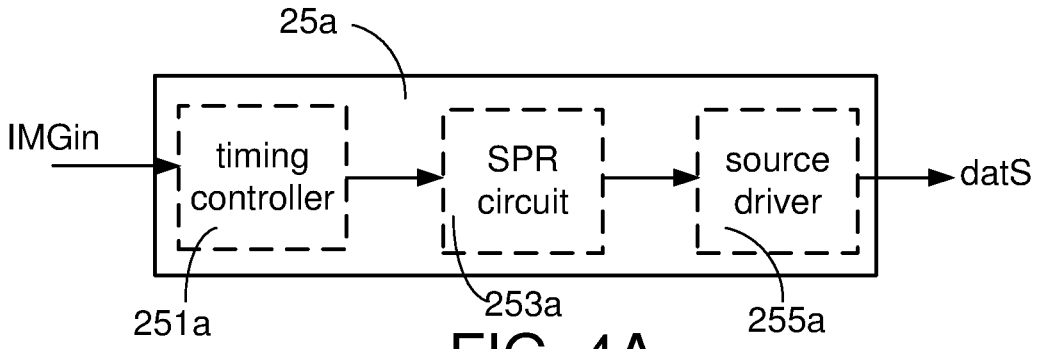
FIGS. 4A, 4B and 4C are schematic diagrams illustrating various ways of implementing the timing controller, the SPR circuit, and the source driver.
Figure 4B:
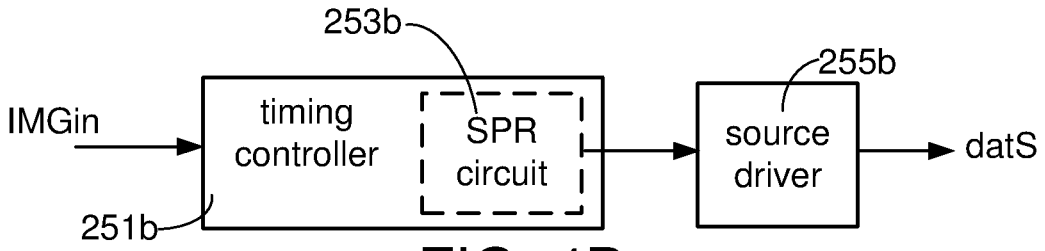
Figure 4C:
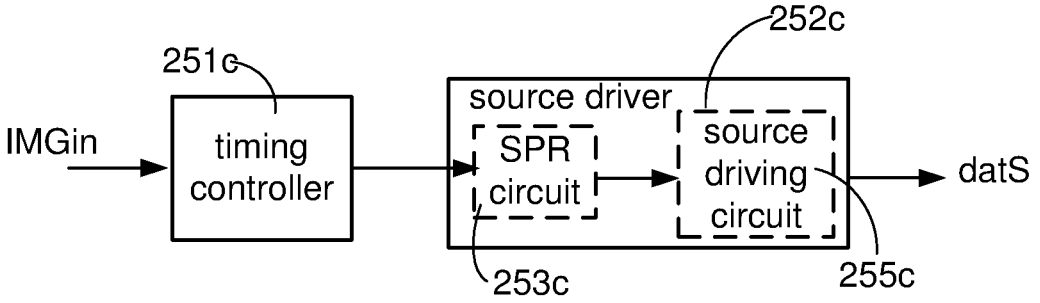

FIGS. 4A, 4B and 4C are schematic diagrams illustrating various exemplary implementations of the timing controller, the SPR circuit, and the source driver. In FIG. 4A, the timing controller 251*a*, the SPR circuit 253*a*, and the source driver 255*a* are jointly integrated into one circuitry 25*a*. In FIG. 4B, the timing controller 251*b* includes the SPR circuit 253*b*, and the source driver 255*b* is a separate circuit. In FIG. 4C, the timing controller 251*c* is a separate circuit, and the SPR circuit 253*c* and the source driving circuit 255*c* are integrated into the source driver 252*c*.

As illustrated above, the SPR circuit 253 transforms color values CV of the colored input points (inPT_c1, inPT_c2, inPT_c3) to the rendered subpixel data sets sprDSET_c1, sprDSET_c2, sprDSET_c3. Such transformation involves positions of the input points (inPT) in the input image IMGin and positions and arrangement of the subpixels on the display panel.

For the sake of illustration, positions of the input points (inPT) are represented by x-y coordinates in parentheses, for example, (x, y). Thus, a colored input point (inPT(x, y)_c)

represents that a red input point is located at the x-th column and the y-th row of the red color-plane of the input image. Representations of the green input points and the blue input points are similar. On the other hand, positions of the subpixels SPX are represented by a-b coordinates in square brackets, for example, [a, b]. Thus, a pixel PX[a, b] including a red subpixel SPX[a, b]_c1, a green subpixel SPX[a, b]_c2, and a blue subpixel SPX[a, b]_c3 is located at the a-th column and the b-th row of the display panel.

The subpixel rendering operation is repetitively performed in units of a selected region SR being alternatively selected from the input image IMGin and a target region TR being alternatively selected from the display area of the display panel. Alternatively speaking, the SPR circuit 253 transforms input points (inPT) in the selected region SR to the pixels located at the target region TR. For the sake of illustration, the pixels in the target region TR are defined as target pixels tgPX, and subpixels of the target pixels tgPX are defined as target subpixels tgSPX. Moreover, the exemplary target region TR is assumed to include 3×3 target pixels tgPX.

To generate the rendered data essential for the target pixels tgPX in a specific target region TR, a selected region SR including multiple colored input points should be defined in the input image IMGin. The number of colored input points in the core area crSR is equivalent to the number of the target pixels tgPX in the target region tgRX. As the exemplary target region TR is assumed to include 3×3 target pixels tgPX, the core area thus includes 3×3 input points. Each of the 3×3 input points include 3 colored input points inPT_c1, inPT_c2, inPT_c3.

The relative positions (layout) of the colored input points in the core areas of different color-planes crSR_c1, crSR_c2, and crSR_c3 can be identical to or different from the relative positions (layout) of the target subpixels in the target region TR. In addition, the relative positions (layout) of the colored input points in the boundary areas of different color-planes bdrySR_c1, bdrySR_c2, bdrySR_c3 can be identical to or different from each other.

In the specification, a direct mapping approach, a coordinate mapping approach or both are provided for determining the colored input points in the core areas crSR_c1, crSR_c2, crSR_c3, that is, the colored input points being considered/defined as the ones actually corresponding to the target subpixels tgSPX. Once the core areas crSR_c1, crSR_c2, crSR_c3 are determined, the colored inputs inPT_c1, inPT_c2, inPT_c3 in the boundary area bdrySR_c1, bdrySR_c2, bdrySR_c3 can determined accordingly.

Figure 2:
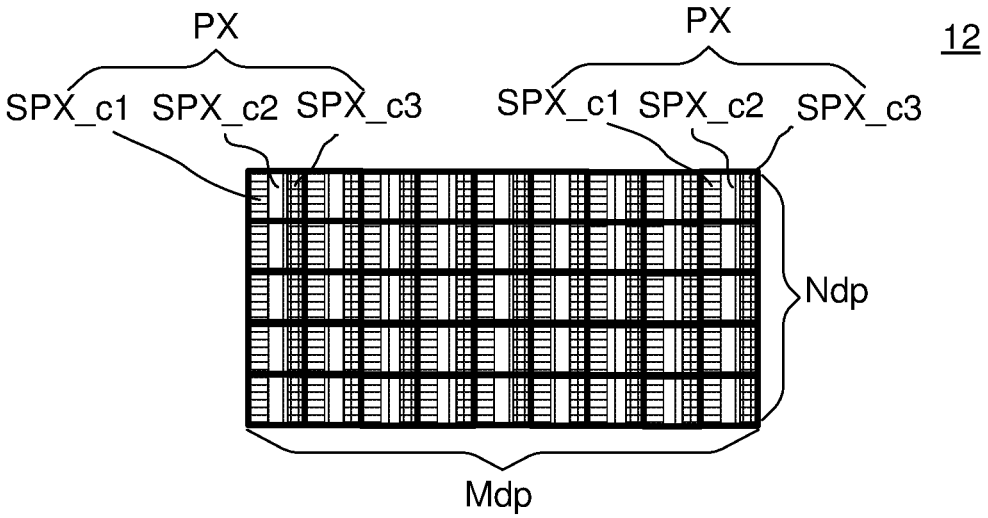
FIG. 2 (PRIOR ART)
FIG. 2 (prior art) is a schematic diagram illustrating subpixels being mounted on a conventional display panel.

Basically, when the subpixel layout of the display panel is similar to the one shown in FIG. 2, the SPR circuit performs a direct mapping between the selected region SR and the target region TR, and the direct mapping results in that the relative positions of the colored input points (inPT_c1, inPT_c2, and inPT_c3) in the core areas (crSR_c1, crSR_c2, and crSR_c3) are identical to each other, and the relative positions of the colored input points (inPT_c1 inPT_c2, inPT_c3) in the boundary area (bdrySR_c1, bdrySR_c2, bdrySR_c3) are identical to each other.

Due to the manufacturing process or some other considerations, the subpixel layout of the display panel 27 is highly unlikely to be similar to the one shown in FIG. 2. In some cases, a subpixel having a certain color is not aligned with the subpixels having the same color. In some other cases, not each of the target pixels tgPX includes the three types of target subpixels tgSPX_c1, tgSPX_c2, tgSPX_c3. Therefore, the subpixel rendering method performed by the SPR circuit should change with these arrangement variations and the direct mapping might not be applicable. More details about how the input points in the core areas crSR_c1, crSR_c2, crSR_c3, and the boundary areas bdrySR_c1, bdrySR_c2, bdrySR_c3 are selected from different color-planes of the input image IMGin_c1, IMGin_c2, IMGin_c3 will be illustrated below.

Figure 5:
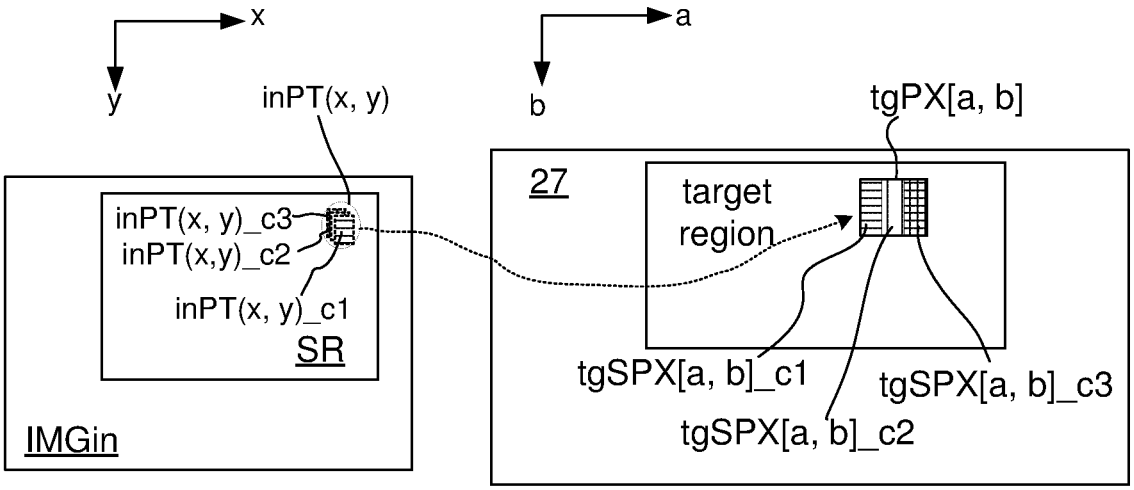
FIG. 5 is a schematic diagram illustrating the coordinate mapping between an input point (inPT(x, y)) in the input image (IMGin) and a target pixel tgPX[a, b] on the display panel.

FIG. 5 is a schematic diagram illustrating the coordinate mapping between an input point (inPT(x, y)) in the input image IMGin and a target pixel tgPX[a, b] on the display panel. In the specification, the coordinate mapping between the input point (inPT(x, y)) and the target pixel tgP[a, b] is performed based on a per-color-plane basis. That is, the mapping from the red input point (inPT(x, y)_c1) to the red target subpixel tgSPX[a, b]_c1, the mapping from the green input point (inPT(x, y)_c2) to the green target subpixel tgSPX[a, b]c2, and the mapping from the blue input point (inPT(x, y)_c3) to the blue target subpixel tgSPX[a, b]_c3 are separate and independent.

When the SPR circuit 253 performs the subpixel rendering to the subpixels of the target point tgPX[a, b], the rendered subpixel data sprD_c1, sprD_c2, sprD_c3 to be displayed by the target pixel tgPX[a, b] is generated based on the color values of the colored input points (inPT(x, y)_c1, inPT(x, y)_c2, inPT(x, y)_c3) and color values of the colored input points which are respectively surrounding the colored input points (inPT(x, y)_c1, inPT(x, y)_c2, inPT(x, y)_c3) to proceed a convolution operation.

Usually, all of the three subpixels SPX_c1, SPX_c2, SPX_c3 of the same pixel PX receive the greatest values of rendered subpixel data (for example, sprD_c1=sprD_c2=sprD_c3=255) to emit the highest luminance when a white color is displayed by the pixel PX. On the other hand, all of the three subpixels SPX_c1, SPX_c2, SPX_c3 of the same pixel PX receive the smallest values of rendered subpixel data (for example, sprD_c1=sprD_c2=sprD_c3=0) to emit the lowest luminance when black color is displayed by the pixel PX. For the sake of illustration, the rendered data for displaying the white color and the black color are simplified to "1" and "0", respectively.

The convolution operation is an important and useful operation in image processing. In each convolution operation, a convolution sum representing a rendered subpixel datum sprD is computed. According to the embodiment of the present disclosure, filter coefficients used in the convolution operation are known in advance.

Figure 6:
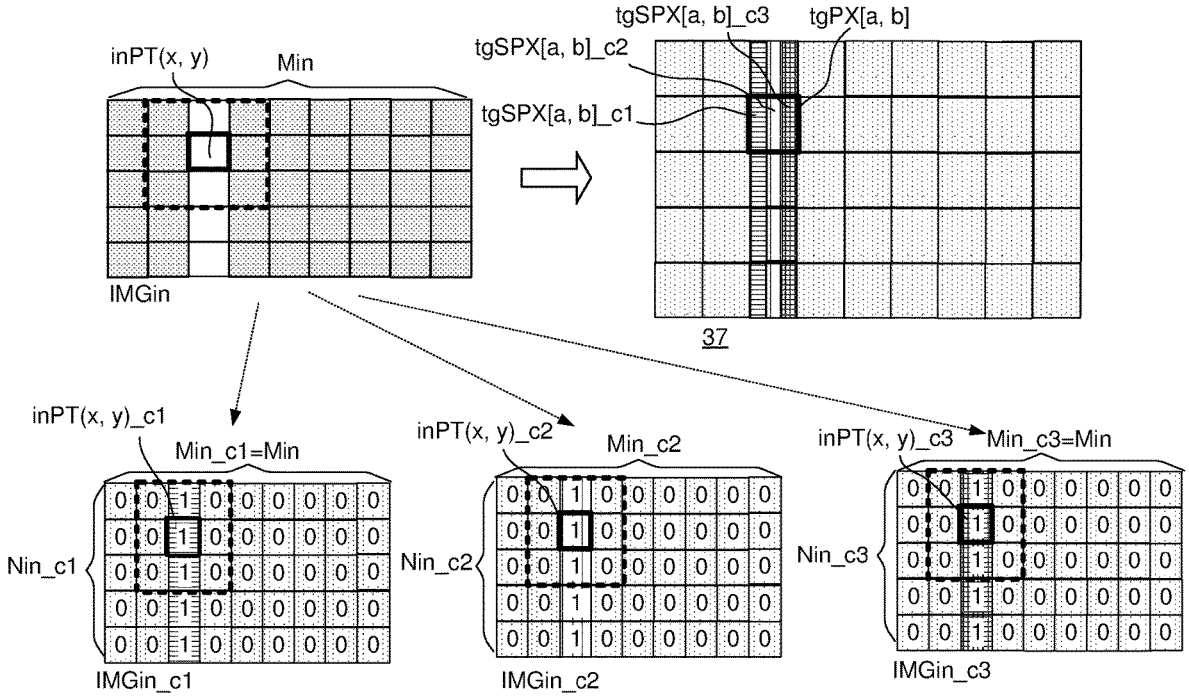
FIG. 6 is a schematic diagram illustrating the transformation from the input image IMGin to the display panel suitable for direct mapping.

FIG. 6 is a schematic diagram illustrating the transformation from the input image IMGin to the display panel suitable for direct mapping. The input image IMGin is assumed to be a white vertical stripe and color values of the colored input points (inPT_c1, inPT_c2, inPT_c3) in the three color-planes which are corresponding to the white vertical stripe are shown.

In FIG. 6, the color values of the colored input points (inPT_c1, inPT_c2, inPT_c3) representing the white vertical stripe are assumed to be "1," and color values of the color input points (inPT_c1, inPT_c2, inPT_c3) not showing the white vertical stripe are assumed to be "0". The white vertical stripe is an exemplary pattern, and the input image IMGin may show different patterns in practical application.

The red input points (inPT_c1) in the red color-plane of the input image IMGin_c1 are arranged in Min_c1 columns and Nin_c1 rows. The green input points (inPT_c2) in the green color-plane of the input image IMGin_c2 are arranged in Min_c2 columns and Nin_c2 rows. The blue input points (inPT_c3) in the blue color-plane of the input image IMGin_c3 are arranged in Min_c3 columns and Nin_c3 rows. In the specification, it is assumed that the column number of input points in the red color-plane, the green color-plane, and the blue color-plane are equivalent (Min_c1=Min_c2=Min_c3=Min), and the row number of input points in the red color-plane, the green color-plane, and the blue color-plane are equivalent (Nin_c1=Nin_c2=Nin_c3=Nin).

In the specification, the display panel 37 is defined as having an RGB-stripe subpixel layout if the following conditions are satisfied. These conditions include that each pixel has a red subpixel SPX_c1, a green subpixel SPX_c2, and a blue subpixel SPX_c3, and the colored subpixels having the same color are aligned with each other in columns and rows.

In a case that the display panel has the RGB-stripe subpixel layout, the SPR circuit performs the direct mapping between the three colored input points (inPT(x, y)_c1, inPT(x, y)_c2, inPT(x, y)_c3) and the three target subpixels (tgPX[a, b]_c1, tgPX[a, b]_c2, tgPX[a, b]_c3). In a case that the display panel does not have the RGB-stripe subpixel layout, the SPR circuit adopts a coordinate shift mapping between the three colored input points (inPT(x, y)_c1, inPT(x, y)_c2, inPT(x, y)_c3) and the three target subpixels (tgPX[a, b]_c1, tgPX[a, b]_c2, tgPX[a, b]_c3).

To generate the rendered subpixel datum sprD_c1 for the red target subpixel tgSPX[a, b]_c1, the red color values of the red input point (inPT(x, y)_c1) and its 8 adjacent red input points are used together to calculate with a red filter kernel FMx_c1. To generate the rendered subpixel datum sprD_c2 for the green target subpixel tgSPX[a, b]_c2, the green color values of the green input points (inPT(x, y)_c1) and its 8 adjacent green input points are used together to calculate with a green filter kernel (FMx_c2). To generate the rendered subpixel datum sprD_c3 for the blue target subpixel tgSPX[a, b]c3, the blue color values of the blue input point (inPT(x, y)_c3) and its 8 adjacent blue input points are used together to calculate with a blue filter kernel (FMx_c3).

In the specification, the symbols used together with braces "{x, y}" represent the data related to the input point (inPT(x, y)). For example, the symbol CV{x, y}c1 represents the red color value CV of the red input point (inPT(x, y)_c1).

Figure 7:
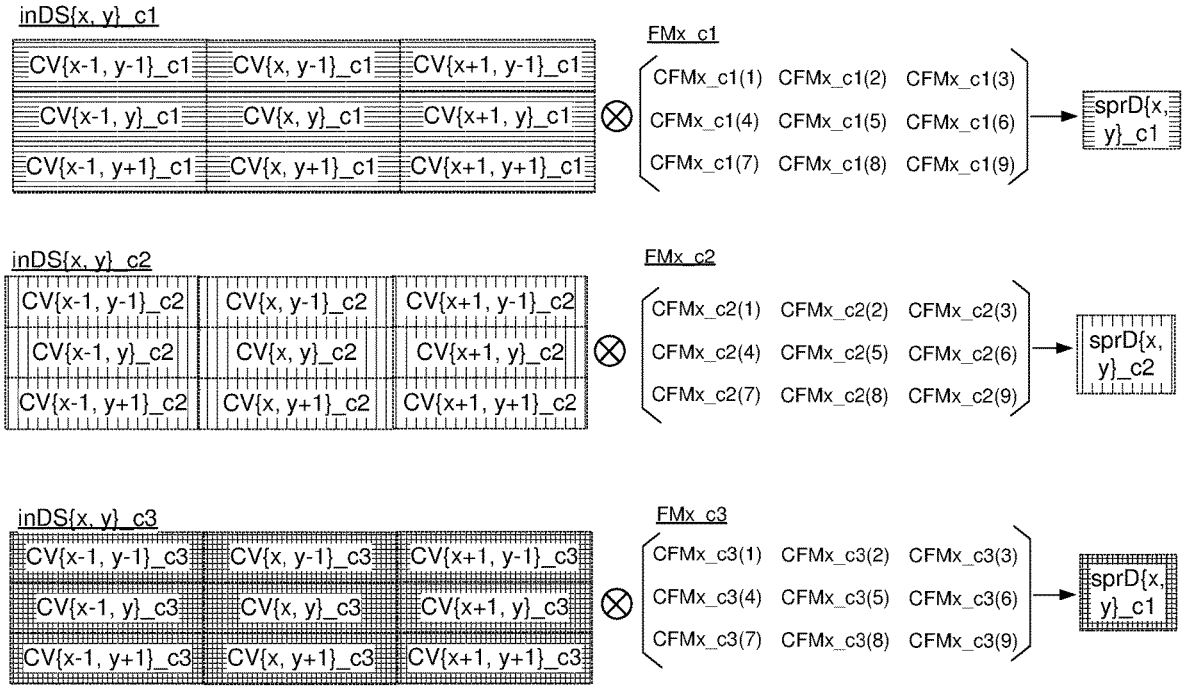
FIG. 7 is a schematic diagram illustrating generation of the rendered subpixel data.

FIG. 7 is a schematic diagram illustrating generation of the rendered subpixel data. The upper part, the middle part, and the bottom part of FIG. 7 are corresponding to generation of the rendered subpixel data sprD {x, y}_c1, sprD{x, y}_c2, sprD{x, y}_c3, respectively.

The red color values CV{x−1, y−1}c1~CV{x+1, y+1}_c1 jointly form a red sampling matrix inDS{x, y}_c1. The green color values CV{x−1, y−1}_c2~CV{x+1, y+1}c2 jointly form a green sampling matrix inDS{x, y}_c2. The blue color values CV{x−1, y−1}_c3~CV{x+1, y+1}_c3 jointly form a blue sampling matrix inDS{x, y}_c3. The red input point (inPT(x, y)_c1) is defined as a red core element of the red sampling matrix inDS{x, y}c1 in one convolution operation, and the red input points (inPT(x−1, y−1)_c1, inPT(x, y−1)_c1, inPT(x+1, y−1)_c1, inPT(x+1, y)_c1, inPT(x+1, y+1)_c1, inPT(x, y+1)_c1, inPT(x−1, y+1)_c1, inPT(x−1, y)_c1) are defined as boundary elements of the red sampling matrix (inDS{x, y}_c1) in one convolution operation. Similar definitions can be applied to the green input points (inPT(x−1, y−1)_c2~inPT(x+1, y+1)_c2) and the blue input points (inPT(x−1, y−1)_c3~inPT(x+1, y+1)_c3) as well.

In the specification, it is assumed that the red filter kernel (FMx_c1) is a rendering convolution matrix includes rendering filter coefficients CFMx_c1(1)~CFMx_c1(9), the green filter kernel (FMx_c2) is another rendering convolution matrix includes rendering filter coefficients CFMx_c2(1)~CFMx_c2(9), and the blue filter kernel (FMx_c3) is still another rendering convolution includes rendering filter coefficients CFMx_c3(1)~CFMx_c3(9). Values of the rendering filter coefficients are related to characteristics of the subpixel rendering function to be provided by the SPR circuit.

The red sampling matrix inDS{x, y}_c1 and the red filter kernel FMx_c1 are utilized together to generate the red rendered subpixel datum sprD{x, y}_c1, which is utilized to determine the luminance of the target subpixel tgSPX[a, b]_c1. The green sampling matrix inDS{x, y}_c2 and the green filter kernel FMx_c2 are utilized together to generate the green rendered subpixel datum sprD{x, y}_c2, which is utilized to determine the luminance of the target subpixel tgSPX[a, b]_c2. The blue sampling matrix inDS{x, y}_c3 and the blue filter kernel FMx_c3 are utilized together to generate the blue rendered subpixel datum sprD{x, y}_c3, which is utilized to determine the luminance of the target subpixel tgSPX[a, b]_c3.

The red filter kernel FMx_c1, the green filter kernel FMx_c2, and the blue filter kernel FMx_c3 are essential for digital image processing, and providing storage space for the rendering filter coefficients CFMx_c1(1)~CFMx_c1(9), CFMx_c2(1)~CFMx_c2(9), CFMx_c3(1)~CFMx_c3(9) for convolution operation is essential. However, the storage space in the display control circuit is limited, and it is preferred to reduce the amount of the rendering filter coefficients to be stored. In other words, the storage space can be decreased if the rendering filter coefficients in the filter kernels can be commonly reused for different color-planes IMGin_c1, IMGin_c2, IMGin_c3.

Figure 8:
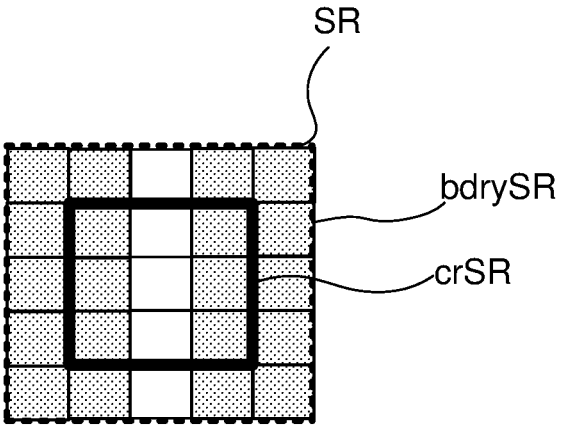
FIG. 8 is a schematic diagram illustrating an exemplary selected region SR acquired from the input image IMGin in FIG. 6.

FIG. 8 is a schematic diagram illustrating an exemplary selected region SR acquired from the input image IMGin in FIG. 6. The exemplary selected region SR showing part of the white vertical stripe includes a core area crSR and a boundary area bdrySR. The input points (inPT_c1, inPT_c2, inPT_c3) in the core area crSR_c1, crSR_c2, crSR_c3 are the ones being utilized as the core elements. The input points (inPT) being used for calculating the rendered subpixel data but not located in the core area crSR_c1, crSR_c2, crSR_c3 are defined as the input points located at the boundary area bdrySR_c1, bdrySR_c2, bdrySR_c3. Alternative speaking, the input points (inPT) forming the boundary area bdrySR are the ones being utilized as the boundary elements only. Relatively, some of the input points in the core area crSR might also be utilized as the boundary elements while other input points are utilized as the core elements in different convolution operations.

The core area crSR in the red color-plane, the green color-plane, and the blue color-plane of the input image (IMGin_c1, IMGin_c2, IMGin_c3) are represented as crSR_c1, crSR_c2, and crSR_c3, respectively. The boundary area in the red color-plane, the green color-plane, and the blue color-plane of the input image (IMGin_c1, IMGin_c2, IMGin_c3) are represented as bdrySR_c1, bdrySR_c2, and bdrySR_c3, respectively.

According to the embodiment of the present disclosure, each of the core areas crSR_c1, crSR_c2, and crSR_c3 has the same quantities of core elements, for example, 3×3=9 core elements. Despite this, the relative positions of the core elements in the core areas crSR_c1, crSR_c2, and crSR_c3 might be different. On the other hand, numbers of the boundary elements in the boundary area bdrySR_c1, bdrySR_c2, bdrySR_c3 may or may not be equivalent but related to the relative positions of the core elements. Accordingly, sizes of the selected regions SR_c1, SR_c2, SR_c3 may or may not be the same. When the relative positions of the core elements in the selected regions SR_c1, SR_c2, SR_c3 are different, sizes of the selected regions SR_c1, SR_c2, SR_c3 are different.

Figure 9:
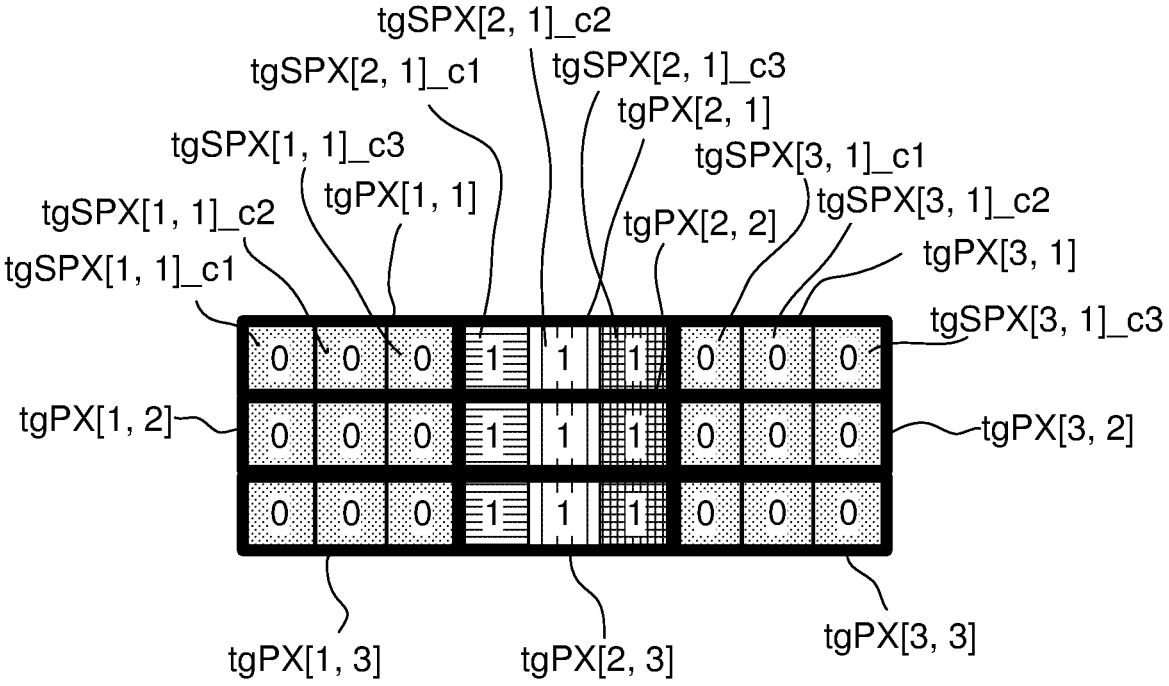
FIG. 9 is a schematic diagram illustrating an exemplary target region TR displaying the white vertical stripe.

FIG. 9 is a schematic diagram illustrating an exemplary target region TR displaying the white vertical stripe. In FIG. 9, each target pixel tgPX[a, b](a=1~3, b=1~3) includes three target subpixels tgSPX, that is, a red target subpixel tgSPX [a, b]_c1, a green target subpixel tgSPX[a, b]_c2, and a blue target subpixel tgSPX[a, b]_c3. Due to the limited space, only the target subpixels located at the first row are notified in FIG. 9.

When the direct mapping is applied to the display panel having the RGB-stripe subpixel layout, the relative positions between the target subpixels tgSPX in the target region TR and the relative positions between the core elements in the core area crSR are consistent. Alternatively speaking, the mappings between the colored input points (inPT(x,y)_c1, inPT(x, y)_c2, inPT(x, y)_c3) and the target subpixels (tgSPX[a, b]_c1, tgSPX[a, b]_c3, tgSPX[a, b]_c3) are satisfied with the conditions that x=a and y=b (x=1~3, y=1~3, a=1~3, b=1~3).

Under such circumstance, the luminance of the target subpixel tgSPX[1, 1]_c1 is determined by the rendered subpixel data sprD{1, 1}_c1 which is generated by the convolution operation based on the red filter kernel FMx_c1 and the red sampling matrix inDS{1, 1}_c1, in which the red input point (inPT(1, 1)_c1) is selected as the red core element. Similarly, the luminance of the target subpixel tgSPX[1, 1]_c2 is determined by the rendered subpixel data sprD{1, 1}_c2 which is generated by the convolution operation based on the green filter kernel FMx_c2 and the green sampling matrix inDS{1, 1}_c2, in which the green input point (inPT(1, 1)_c2) is selected as the green core element, and the luminance of the target subpixel tgSPX[1, 1]_c3 is determined by the rendered subpixel data sprD{1, 1}_c3 which is generated by the convolution operation based on the blue filter kernel FMx_c3 and the blue sampling matrix inDS{1, 1}c3, in which the blue input point (inPT(1, 1)_c3) is selected as the blue core element. The relationships between the other colored input points, rendered subpixel data, and target subpixels are similar so that details are not further described.

It is obtained that the target subpixels at the first column (tgPX[a, b]_c1, tgPX[a, b]_c2, tgPX[a, b]_c3, where a=1 and b=1~3) and the target subpixels at the third column (tgPX[a, b]_c1, tgPX[a, b]_c2, tgPX[a, b]_c3, where a=3 and b=1~3) display the rendered subpixel data equivalent to "0". On the other hand, the target subpixels at the second column (tgPX[a, b]_c1, tgPX[a, b]_c2, tgPX[a, b]_c3, where a=2 and b=1~3) display the rendered subpixel data being equivalent to "1". Thus, the white vertical stripe can be displayed appropriately.

Figure 18:
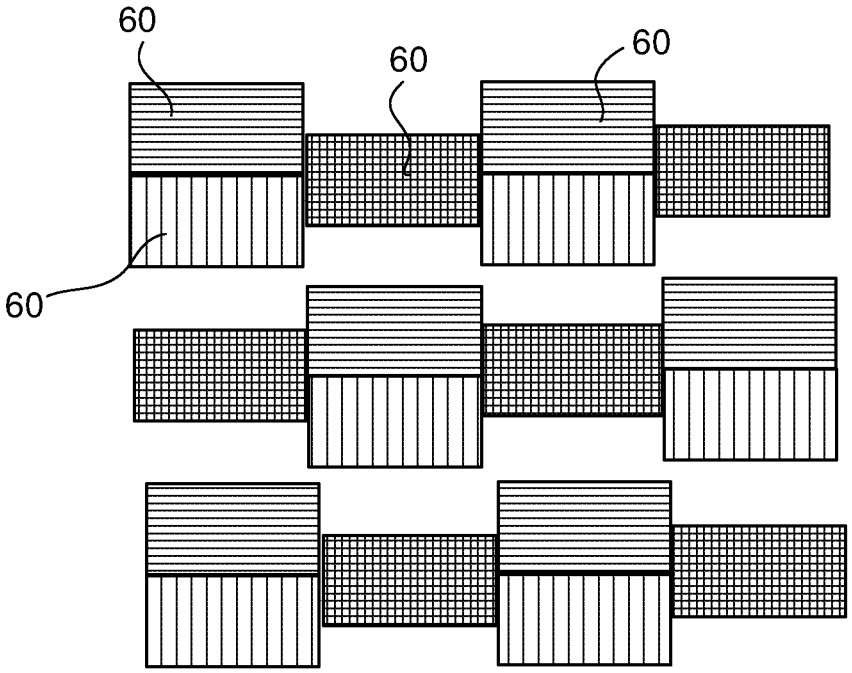
FIG. 18 is a top view diagram illustrating an exemplary pixel layout of an OLED display panel.
Figure 27:
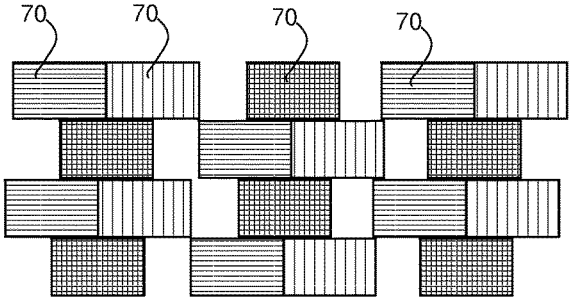
FIG. 27 is a top view diagram illustrating another exemplary pixel layout of an OLED display panel.

In some applications, the subpixel layout of the display panel is not RGB-stripe. The SPR circuit, according to the embodiment of the present disclosure, provides the coordinate shift mapping to the display panel having a non-RGB-stripe subpixel layout. The display panel having the non-RGB-stripe subpixel layout implies that the subpixel configurations of the pixels on the display panel are not all the same. The non-RGB-stripe subpixel layout can be, for example, 2D pattern subpixel layout, RGBW subpixel layout, RGB-stripe subpixel layout, multi-primary subpixel layout, and so forth. FIG. 10 is an example showing that not all the three target subpixels tgSPX of the same target pixel tgPX are aligned in a unified manner. FIGS. 18 and 27 are examples showing that the target pixels tgPX may include only two target subpixels tgSPX.

FIG. 10 is a schematic diagram illustrating the target region of a display panel having staggered subpixel layout. A target region TR including 3×3 target pixels tgPX is shown. Each of the target pixels tgPX[a, b] (a=1~3, and b=1~3) includes a red target subpixel tgSPX[a, b]_c1, a green target subpixel tgSPX[a, b]_c2, and a blue target subpixel tgSPX[a, b]_c3.

As shown in FIG. 10, the target subpixels having the same color are not aligned in all rows. In short, the target subpixels tgSPX at the second row (b=2) are relatively right shifted for a width of a subpixel. For example, the red target subpixel tgSPX[1, 2]_c1 is not aligned with the red target subpixel tgSPX[1, 1]_c2. Instead, the red target subpixel tgSPX[1, 2]_c1 is aligned with the green target subpixel tgSPX[1, 1]_c2. Similarly, instead of being aligned with the green target subpixel tgSPX[1, 1]_c2, the green target subpixel tgSPX[1, 2]_c2 is aligned with the blue target subpixel tgSPX[1, 1]_c3.

As the storage space in the display control circuit is limited, it is desired that the same set of rendering filter coefficients in the rendering convolution matrixes can be repetitively reused for different color-planes IMGin_c1, IMGin_c2, IMG_c3. FIG. 11A is a schematic diagram illustrating a scenario that the red filter kernel FMx_c1, the green filter kernel FMx_c2, and the blue filter kernel FMx_c3 having identical values of rendering filter coefficients. When the display panel has the subpixel layout shown in FIG. 10, and the direct mapping is utilized with the filter kernels shown in FIG. 11A, the display panel will have the visual result shown in FIG. 11B.

FIG. 11B is a schematic diagram illustrating the target subpixels tgSPX in FIG. 10 displaying the rendered subpixel data generated based on the direct mapping approach. As shown in FIG. 11B, the second row of the white vertical stripe is right shifted with a width of one subpixel. Instead of showing the white vertical stripe, the display panel shows a skewed white stripe.

Figure 12A:
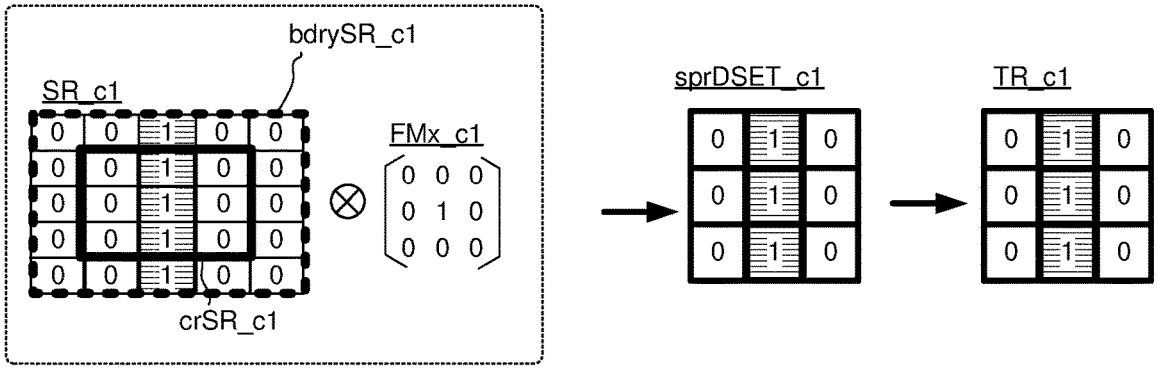
FIG. 12A is a schematic diagram illustrating generation of the red rendered subpixel data sprD{x, y}_c1 to be respectively provided to the red target subpixels tgSPX[a, b]_c1 based on the coordinate shift mapping according to the embodiment of the present disclosure.
Figure 12B:
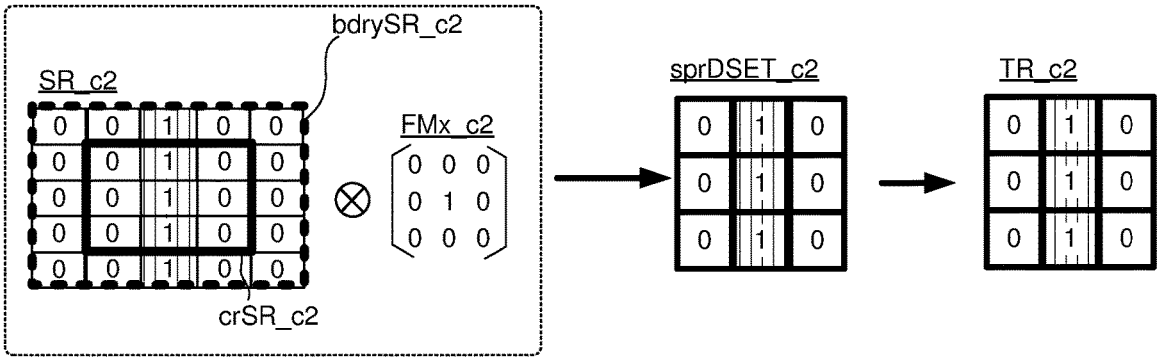
FIG. 12B is a schematic diagram illustrating generation of the green rendered subpixel data sprD{x, y}_c2 to be respectively provided to the green target subpixels tgSPX[a, b]_c2 based on the coordinate shift mapping according to the embodiment of the present disclosure.
Figure 12C:
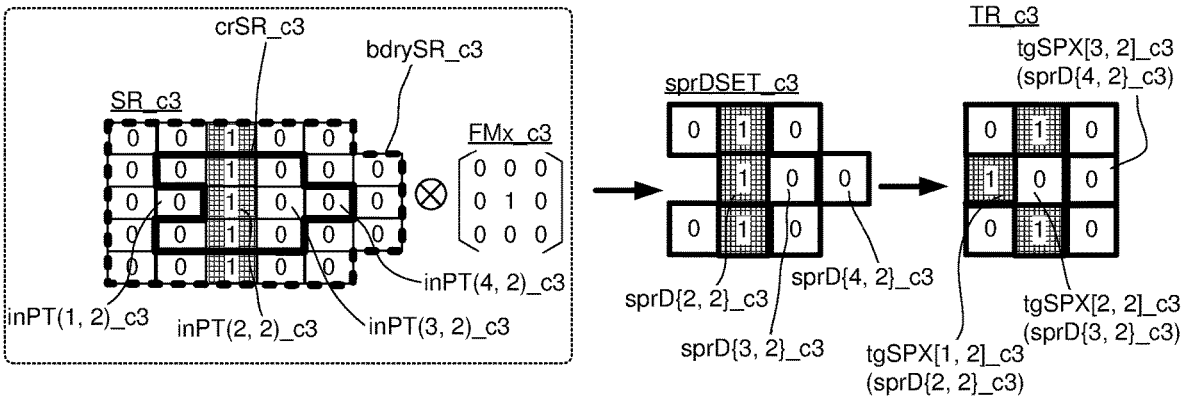
FIG. 12C is a schematic diagram illustrating generation of the blue rendered subpixel data sprD{x, y}_c3 to be respectively provided to the blue target subpixels tgSPX[a, b]_c3 based on the coordinate shift mapping according to the embodiment of the present disclosure.

To prevent the displayed image from having the skewed phenomena, the coordinate shift mapping is provided to the occasions when the subpixel layout of the display panel is not RGB-stripe. In short, the subpixel layout of the display panel is taken into consideration by the coordinate shift mapping. By doing so, the areas and positions of the selected regions SR in different color-planes IMGin_c1, IMGin_c2, IMGin_c3 may not be consistent. FIGS. 12A, 12B, 12C are respectively corresponding to generation of the rendered subpixel data sprD_c1, sprD_c2, sprD_c3, which are further transmitted to the target subpixels tgSPX_c1, tgSPX_c2, tgSPX_c3 to determine their luminances.

FIG. 12A is a schematic diagram illustrating generation of the red rendered subpixel data sprD{x, y}_c1 to be respectively provided to the red target subpixels tgSPX[a, b]_c1 based on the coordinate shift mapping according to the embodiment of the present disclosure. The dotted frame at the left part of FIG. 12A shows the red selected region SR_c1 and the red filter kernel FMx_c1. In the red selected region SR_c1, each grid represents the red color value of a red input point (inPT_c1) in the red selected region SR_c1. The area circulated by a thick line represents the core area crSR_c1. The area between the thick dotted line and the thick line represents the boundary area bdrySR_c1.

According to FIG. 12A, the core area crSR_c1 includes 9 red input points (inPT(1, 1)_c1~inPT(3, 3)_c1), and the boundary area bdrySR_c1 includes 16 red input points (inPT_c1). By repetitively performing the convolution operation to the red sampling matrixes inDS{x, y}_c1 having the red input points (inPT_c1) in the core area crSR_c1 as their corresponding red core elements with the red filter kernel FMx_c1, the red rendered subpixel data sprD{1, 1}_c1~sprD{3, 3}_c1 are generated. Then, the red rendered subpixel data sprD{1, 1}_c1~sprD{3, 3}_c1 are respectively transmitted to and utilized by the red target subpixels tgSPX[1, 1]_c1~tgPX[3, 3]_c1. The red rendered subpixel data sprD{1, 1}_c1~sprD{3, 3}_c1 collectively form the red rendered subpixel data set sprDSET_c1.

The corresponding relationships between the red target subpixels tgSPX[a, b]_c1, the red rendered subpixel data sprD{x, y}_c1, and the horizontal/vertical coordinate shift parameters of color red are summarized in Table 1.

TABLE 1

| coordinate of red rendered subpixel data sprD{x, y}_c1 | | coordinate of red target subpixel tgSPX[a, b]_c1 | | horizontal coordinate shift parameter Δx_c1 (a-x) | vertical coordinate shift parameter Δy_c1 (b-y) |
|---|---|---|---|---|---|
| x = 1 | y = 1 | a = 1 | b = 1 | 0 | 0 |
| x = 2 | | a = 2 | | 0 | 0 |
| x = 3 | | a = 3 | | 0 | 0 |
| x = 1 | y = 2 | a = 1 | b = 2 | 0 | 0 |
| x = 2 | | a = 2 | | 0 | 0 |
| x = 3 | | a = 3 | | 0 | 0 |
| x = 1 | y = 3 | a = 1 | b = 3 | 0 | 0 |
| x = 2 | | a = 2 | | 0 | 0 |
| x = 3 | | a = 3 | | 0 | 0 |

In FIG. 12A, the relative positions between the red target subpixels tgSPX[a, b]_c1 and the relative positions between the red core elements in the core area crSR_c1 are consistent. Thus, coordinates (x, y) of the red input points inPT(x, y)_c1 in the core area crSR_c1 of the red color-plane IMGin_c1 can be directly mapped to the coordinates [a, b] of the red target subpixels tgSPX[a, b]_c1 in the target region TR_c1. In other words, the direct mapping can be applied to the red color-plane IMGin_c1, and the mapping between the red input points inPT(x, y)_c1 and the red target subpixels tgSPX[a, b]_c1 is satisfied with a=x and b=y.

FIG. 12B is a schematic diagram illustrating generation of the green rendered subpixel data sprD{x, y}c2 to be respectively provided to the green target subpixels tgSPX[a, b]_c2 based on the coordinate shift mapping according to the embodiment of the present disclosure. The dotted frame at the left part of FIG. 12B shows the green selected region SR_c2 and the green filter kernel FMx_c2. In the green selected region (SR_c2), each grid represents the green color value of a green input point (inPT_c2 in) the green selected region (SR_c2). The area circulated by a thick line represents the core area crSR_c2. The area between the thick dotted line and the thick line represents the boundary area bdrySR_c2.

According to FIG. 12B, the core area crSR_c2 includes 9 green input points (inPT(1, 1)_c2~inPT(3, 3)_c2), and the boundary area bdrySR_c2 includes 16 green input points (inPT_c2). By repetitively performing the convolution operation to the green sampling matrixes inDS{x, y}_c2 having the green input points (inPT_c2) in the core area crSR_c2 as their corresponding green core elements with the green filter kernel FMx_c2, the green rendered subpixel data sprD{1, 1}c2~sprD{3, 3}_c2 are generated. Then, the green rendered subpixel data sprD{1, 1}_c2~sprD{3, 3}_c2 are respectively transmitted to and utilized by the green target subpixels tgSPX[1, 1]_c2~tgPX[3, 3]_c2. The green rendered subpixel data sprD{1, 1}_c2~sprD{3, 3}c2 collectively form the green rendered subpixel data set sprDSET_c2.

The corresponding relationships between the green target subpixels tgSPX[a, b]_c2, the green rendered subpixel data sprD{x, y}_c2, and the horizontal/vertical coordinate shift parameters of color green are summarized in Table 2.

TABLE 2

| coordinate of green rendered subpixel data sprD{x, y}_c2 | | coordinate of green target subpixel tgSPX[a, b]_c2 | | horizontal coordinate shift parameter Δx_c2 (a-x) | vertical coordinate shift parameter Δy_c2 (b-y) |
|---|---|---|---|---|---|
| x = 1 | y = 1 | a = 1 | b = 1 | 0 | 0 |
| x = 2 | | a = 2 | | 0 | 0 |
| x = 3 | | a = 3 | | 0 | 0 |
| x = 1 | y = 2 | a = 1 | b = 2 | 0 | 0 |
| x = 2 | | a = 2 | | 0 | 0 |
| x = 3 | | a = 3 | | 0 | 0 |
| x = 1 | y = 3 | a = 1 | b = 3 | 0 | 0 |
| x = 2 | | a = 2 | | 0 | 0 |
| x = 3 | | a = 3 | | 0 | 0 |

In FIG. 12B, the relative positions between the green target subpixels tgSPX[a, b]_c2 and the relative positions between the green core elements in the core area crSR_c2 are consistent. Thus, coordinates (x, y) of the green input points inPT(x, y)_c2 in the core area crSR_c2 of the green color-plane IMGin_c2 can be directly mapped to the coordinates [a, b] of the green target subpixels tgSPX[a, b]_c2 in the target region TR_c2. In other words, the direct mapping can be applied to the green color-plane IMGin_c2 and the mapping between the green input points inPT(x, y)_c2 and the green target subpixels tgSPX[a, b]_c2 is satisfied with a=x and b=y.

FIG. 12C is a schematic diagram illustrating generation of the blue rendered subpixel data sprD{x, y}_c3 to be respectively provided to the blue target subpixels tgSPX[a, b]_c3 based on the coordinate shift mapping according to the embodiment of the present disclosure. The dotted frame at the left part of FIG. 12C shows the blue selected region SR_c3 and the blue filter kernel (FMx_c3). In the blue selected region (SR_c3), each grid represents the blue color value of a blue input point (inPT_c3) in the blue selected region (SR_c3). The area circulated by the thick line represents the core area (crSR_c3). The area between the thick dotted line and the thick line represents the boundary area (bdrySR_c3).

According to FIG. 12C, the core area crSR_c3 includes 9 blue input points (inPT(1, 1)_c3~inPT(3, 1)_c3, inPT(2, 2)_c3~inPT(4, 2)_c3, inPT(1, 3)_c3~inPT(3, 3)_c3), and the boundary area bdrySR_c3 includes 19 blue input points (inPT_c3). By repetitively performing the convolution operation to the green sampling matrixes inDS{x, y}_c3 having the blue input points (inPT_c3) in the core area crSR_c3 as their corresponding blue core elements with the blue filter kernel FMx_c3, the blue rendered subpixel data sprD{1, 1}_c3~sprD{3, 1}_c3, sprD{2, 2}_c3~sprD{4, 2}_c3, sprD{1, 3}_c3~sprD{3, 3}_c3 are generated. Then, the blue rendered subpixel data sprD{1, 1}_c3~sprD{3, 1}_c3, sprD{2, 2}_c3~sprD{4, 2}_c3, sprD{1, 3}_c3~sprD{3, 3}_c3 are respectively transmitted to and utilized by the blue target subpixels tgSPX[1, 1]_c3~tgPX[3, 3]_c3. The blue rendered subpixel data sprD{1, 1}_c3~sprD{3, 1}_c3, sprD{2, 2}_c3~sprD{4, 2}_c3, sprD{1, 3}_c3~sprD{3, 3}_c3 collectively form the blue rendered subpixel data set sprDSET_c3.

In FIG. 12C, the relative positions between the blue target subpixels tgSPX[a, b]_c3 and the relative positions between the blue core elements in the core area crSR_c3 are not completely consistent. Thus, coordinates (x, y) of the blue input points inPT(x, y)_c3 in the core area crSR_c3 of the blue color-plane IMGin_c3 needs to be shifted before being mapped to the coordinates [a, b] of the blue target subpixels tgSPX[a, b]_c3 in the target region TR_c3. Among the 3×3 blue input points inPT_c3, the coordinate shift mapping should be adapted to the mapping between the blue input points at the second row of the core area crSR_c3 (that is, blue input points inPT(x, y)_c3, wherein x=1~3 and y=2) and the blue target subpixels at the second row of the blue target region TR_c3 (that is, blue target pixels tgSPX[a, b]_c3, wherein a=1~3 and b=2).

The corresponding relationships between the blue target subpixels tgSPX[a, b]_c3, the blue rendered subpixel data sprD{x, y}_c3, and the horizontal/vertical coordinate shift parameters of color blue are summarized in Table 3.

TABLE 3

| coordinate of blue rendered subpixel data sprD{x, y}_c3 | | coordinate of blue target subpixel tgSPX[a, b]_c3 | | horizontal coordinate shift parameter Δx_c3 (a-x) | vertical coordinate shift parameter Δy_c3 (b-y) |
|---|---|---|---|---|---|
| x = 1 | y = 1 | a = 1 | b = 1 | 0 | 0 |
| x = 2 | | a = 2 | | 0 | 0 |
| x = 3 | | a = 3 | | 0 | 0 |
| x = 2 | y = 2 | a = 1 | b = 2 | −1 | 0 |
| x = 3 | | a = 2 | | −1 | 0 |
| x = 4 | | a = 3 | | −1 | 0 |
| x = 1 | y = 3 | a = 1 | b = 3 | 0 | 0 |
| x = 2 | | a = 2 | | 0 | 0 |
| x = 3 | | a = 3 | | 0 | 0 |

In FIG. 12C, coordinate of the blue input point (inPT(x, y)_c3, y=2) is not directly mapped to coordinate of the blue target subpixel (tgSPX[a, b]_c3, b=2). Thus, x=a is not satisfied. Instead, a=(x−1) is satisfied. Alternatively speaking, the blue rendered subpixel datum sprD{1, 2}_c3 is generated for and utilized by the blue target pixel tgSPX[1, 2]_c3; the blue rendered subpixel datum sprD{3, 2}_c3 is generated for and utilized by the blue target pixel tgSPX[2, 2]_c3; and the blue rendered subpixel datum sprD{4, 2}_c3 is generated for and utilized by the blue target pixel tgSPX [3, 2]_c3.

In other words, for the mapping between the blue input points inPT(x, y)_c3 at the second row (y=2) and the blue target subpixels tgSPX[a, b]_c3 at the second row (b=2), the equation a=(x+1) is satisfied. That is, the coordinate shift mapping should be applied to the blue color-plane IMGin_c3.

In the specification, a difference between the horizontal coordinate of the target subpixel "a" and that of the input point "x" is defined as a horizontal coordinate difference (Δx=a−x), and/or a difference between the vertical coordinate of the target subpixel "b" and that of the input point "y" is defined as a vertical coordinate difference (Δy=b−y). The horizontal coordinate difference and the vertical coordinate difference are considered as horizontal/vertical coordinate shift parameters, which are utilized to modify the mapping between the core elements and the target subpixels.

According to the above illustrations, it is possible that direct mapping and the coordinate shift mapping are applied to different color-planes. Or, for the core elements with the same color, it is possible that to apply the direct mapping to some of which and apply the coordinate shift mapping to the other of which. In practical application, the appliances of the direct mapping and the coordinate shift mapping should be determined in response to the physical layout of the target subpixels.

Figure 13:
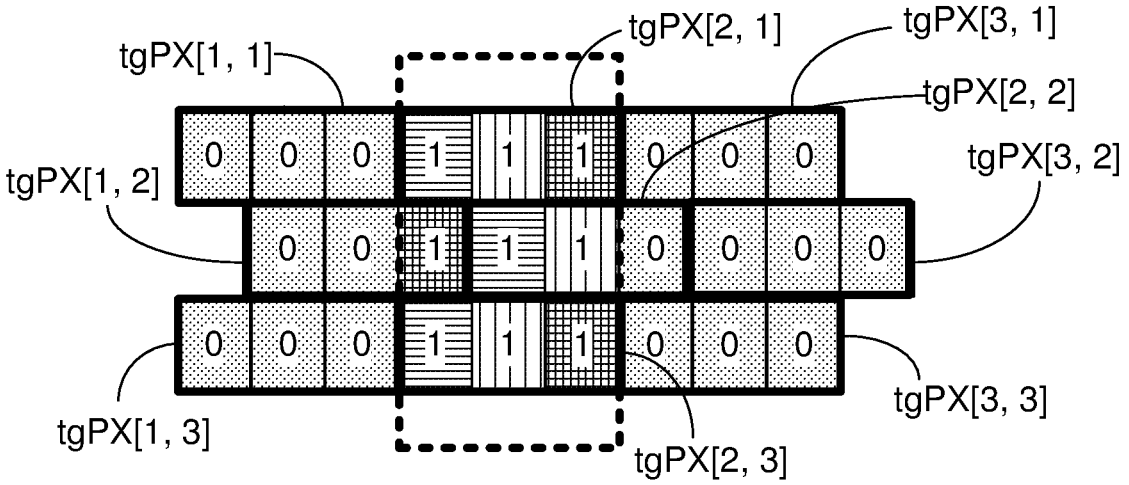
FIG. 13, a schematic diagram illustrating layout of rendered subpixel data of the target pixels based on the coordinate shift mapping according to the embodiment of the present disclosure.
Figure 14:
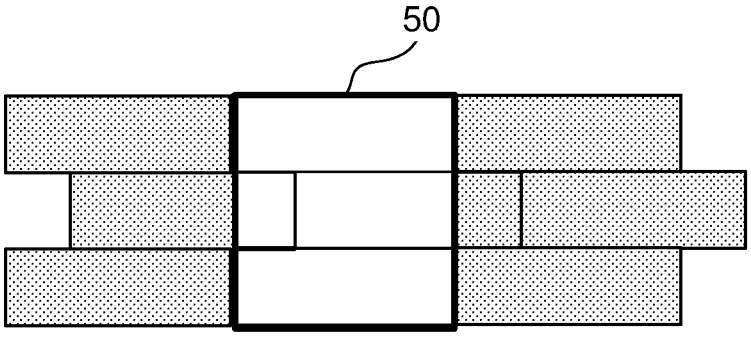
FIG. 14 is a schematic diagram showing the visual effect of the target pixels shown in FIG. 13 in an intuitive way.

Please compare FIGS. 12A, 12B, and 12C together. The layout of the red input points inPT(x, y)_c1 in the core area csSR_c1 and the layout of the green input points inPT(x, y)_c2 in the core area csSR_c2 are the same. However, the layout of the blue input points inPT(x, y)_c3 in the core area crSR_c3 is different from the others. Whereas, number of the red, green, blue input points inPT(x, y)_c1, inPT(x, y)_c2, inPT(x, y)_c3 respectively in the core area csSR_c1, csSR_c2, csSR_c3 are all equivalent to number of the target pixels tgPX[a, b] (that is, 9). The rendering filter coefficients defined in the red filter kernel FMx_c1, the green filter kernel FMx_c2 and the blue filter kernel FMx_c3 are identical. In other words, the same rendering filter coefficients can be repetitively used for generation of the rendered subpixel data of the three color-planes IMGin_c1, IMGin_c2, IMGin_c3 and the storage space required for subpixel rendering can be reduced. The results of FIGS. 12A, 12B, 12C can be utilized to generate FIG. 13, a schematic diagram illustrating the layout of rendered subpixel data of the target pixels tgPx[1, 1]~tgPX[3, 3] based on the combination of the direct mapping and the coordinate shift mapping according to the embodiment of the present disclosure. FIG. 14 shows the display effect of FIG. 13 intuitively, and the white vertical stripe 50 can be correctly displayed.

Figure 15:
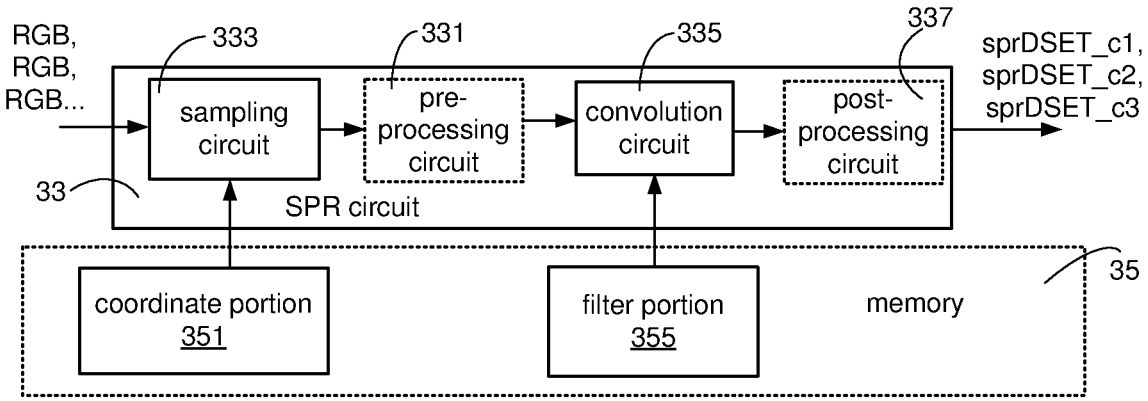
FIG. 15 is a block diagram illustrating components of the SPR circuit.

FIG. 15 is a block diagram illustrating components of the SPR circuit. According to the embodiment of the present disclosure, the SPR circuit 33 is used together with a memory 35. The memory 35 is electrically connected to the SPR circuit 33. In addition to the SPR circuit 33, the memory 35 can be used by other function circuits in the display device.

The SPR circuit 33 includes a sampling circuit 333 and a convolution circuit 335. Optionally, the SPR circuit 33 may have a pre-processing circuit 331, a post-processing circuit 337 or both. The post-processing circuit 337 can be, for example, a low pass filter (hereinafter, LPF), a high pass filter, an edge detector, and so forth. The uses and functions of the pre-processing circuit 331 and the post-processing circuit 337 are not described here. The memory 35 includes a coordinate portion 351 and a filter portion 355.

The coordinate portion 351 stores coordinate shift parameters representing the mapping between the core elements in the selected region SR and the target subpixels in the target region TR based on the coordinate shift mapping. With the coordinate shift parameters, the sampling circuit 333 acquires suitable input points in different color-planes for all the following image processing related operations.

Based on the coordinate shift parameters, the sampling circuit 333 samples the input points to be utilized as the red/green/blue sampling matrixes inDS{x, y}_c1, inDS{x, y}_c2, inDS{x, y}_c3. Then, color values of the input points in the red/green/blue sampling matrixes inDS{x, y}_c1, inDS{x, y}_c2, inDS{x, y}_c3 are transmitted to the convolution circuit 335.

The filter portion 355 stores the rendering filter coefficients of the red/green/blue filter kernels. Based on the color values of the input points in the red/green/blue sampling matrixes inDS{x, y}_c1, inDS{x, y}_c2, inDS{x, y}_c3 and the red/green/blue filter kernels, the convolution circuit 355 performs the convolution operation to generate the rendered subpixel data sets sprDSET_c1, sprDSET_c2, sprDSET_c3. In the specification, the rendering filter coefficients of the red/green/blue filter kernels are entirely identical. Alternatively speaking, only one copy of the rendering filter coefficients needs to be saved, and the storage space required for the filter kernels can be dramatically reduced.

In short, variations of the subpixel layout of the non-RGB-stripe display panel have been pre-transformed by the sampling circuit 333, with reference of the coordinate shift parameters. Thus, the input points acquired by the sampling circuit 333 are different in the red, the green, and the blue color-planes. Inconsequence, the pre-processing circuit 311, the convolution circuit 335, and the post-processing circuit 337 can equally perform their image processing operations to these acquired input points, regardless of their colors. Therefore, use of the coordinate shift parameter(s) can reduce the storage spaces required by the pre-processing circuit 311, the convolution circuit 335, and the post-processing circuit 337.

Technology development drives new types of display panels. For example, organic light-emitting diodes (hereinafter, OLED) offer many advantages over both thin-film-transistor liquid-crystal display (hereinafter, LCD) and light-emitting diode (hereinafter, LED). Due to the manufacturer limitation, subpixels of the OLED display panel require a bigger area.

Figure 16:
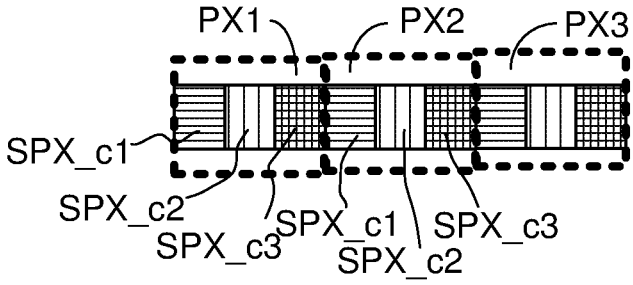
FIG. 16 is a schematic diagram illustrating an example of the pixels having three subpixels.

FIG. 16 is a schematic diagram illustrating an example of the pixels having three subpixels. In FIG. 16, each of the pixels has substantially the same size and the same subpixel layout. Each of the conventional pixels PX1, PX2, PX3 includes a red subpixel SPX_c1, a green subpixel SPX_c2, and a blue subpixel SPX_c3.

Figure 17:
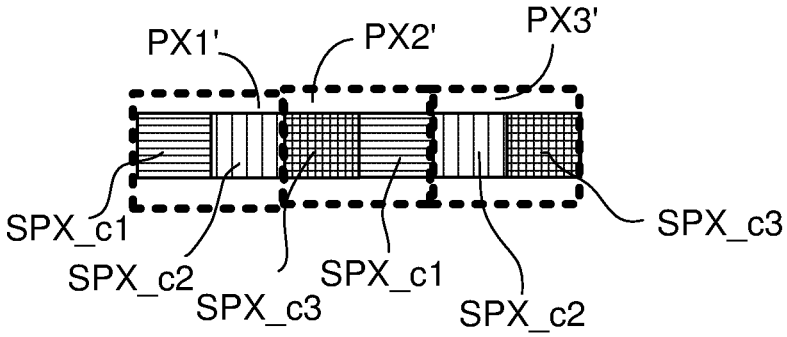
FIG. 17 is a schematic diagram illustrating an example of the OLED pixels having two subpixels.

FIG. 17 is a schematic diagram illustrating an example of the OLED pixels having two subpixels. Unlike the pixels are shown in FIG. 16, each of the OLED pixels PL1', PL2', PL3' includes only two subpixels. The OLED pixel PX1' includes a red OLED subpixel SPX_c1 and a green OLED subpixel SPX_c2, the OLED pixel PX2' includes a blue OLED subpixel SPX_c3 and a red OLED subpixel SPX_c1, and the OLED pixel PX3' includes a green OLED subpixel SPX_c2 and a blue OLED subpixel SPX_c3. That is, the OLED pixels PX1', PX2', PX3' alternatively miss one type of colored OLED subpixels.

Comparing with the pixel PX1, the OLED pixel PX1' does not include a blue OLED subpixel SPX_c3. Comparing with the pixel PX2, the OLED pixel PX2' does not include a green OLED subpixel SPX_c2. Comparing with the pixel PX3, the OLED pixel PX3' does not include a red OLED subpixel SPX_c1. Therefore, the sizes of the OLED subpixels in FIG. 17 can be bigger than the sizes of the subpixels in FIG. 16.

To reduce the side effects of decreasing the number of subpixels, the subpixels corresponding to different colors are alternatively dismissed in FIG. 17. Consequentially, the column numbers of the red/green/blue OLED subpixels of the OLED display panel can be equivalent to or less than the column number of the OLED pixels (Mdp_c1≤Mdp, Mdp_c2≤Mdp, Mdp_c3≤Mdp), and the row number of the red/green/blue OLED subpixels can be equivalent to or less than the row number of the OLED pixels (Ndp_c1≤Ndp, Ndp_c2≤Ndp, Ndp_c3≤Ndp). Thus, designing the SPR circuit specific to the OLED display panel should consider the subpixel layout.

FIG. 18 is a top view diagram illustrating an exemplary non-RGB-stripe pixel layout. In FIG. 18, the subpixels 60 are aligned in a column (vertical) direction but not aligned in a row (horizontal) direction. The subpixels 60 can be, for example, OLED subpixels.

Figure 19A:
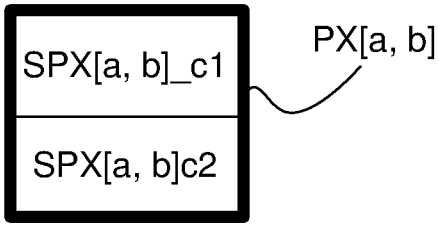
FIGS. 19A, 19B, and 19C are schematic diagrams illustrating three types of pixels in FIG. 18.
Figure 19B:
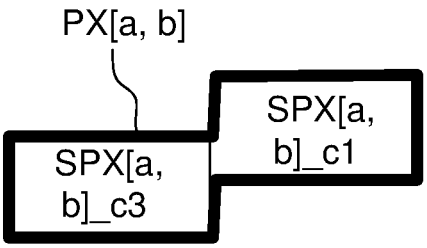
Figure 19C:
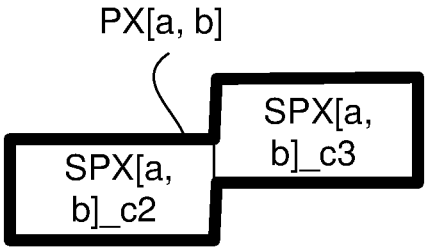

FIGS. 19A, 19B, and 19C are schematic diagrams illustrating three types of pixels in FIG. 18. The pixels in the display panel shown in FIG. 18 can be classified as having three types of subpixel layout. FIG. 19A shows that the first type of subpixel layout includes two horizontally side-by-side subpixels, a red subpixel SPX[a, b]_c1 and a green subpixel SPX[a, b]_c2. The second and the third types of subpixel layout include two subpixels and part of which are vertically side-by-side. A red subpixel SPX[a, b]_c1 and a blue subpixel SPX[a, b]_c3 are shown in FIG. 19B, and a blue subpixel SP[a, b]_c3 and a green subpixel SP[a, b]_c2 are shown in FIG. 19C.

Figure 20:
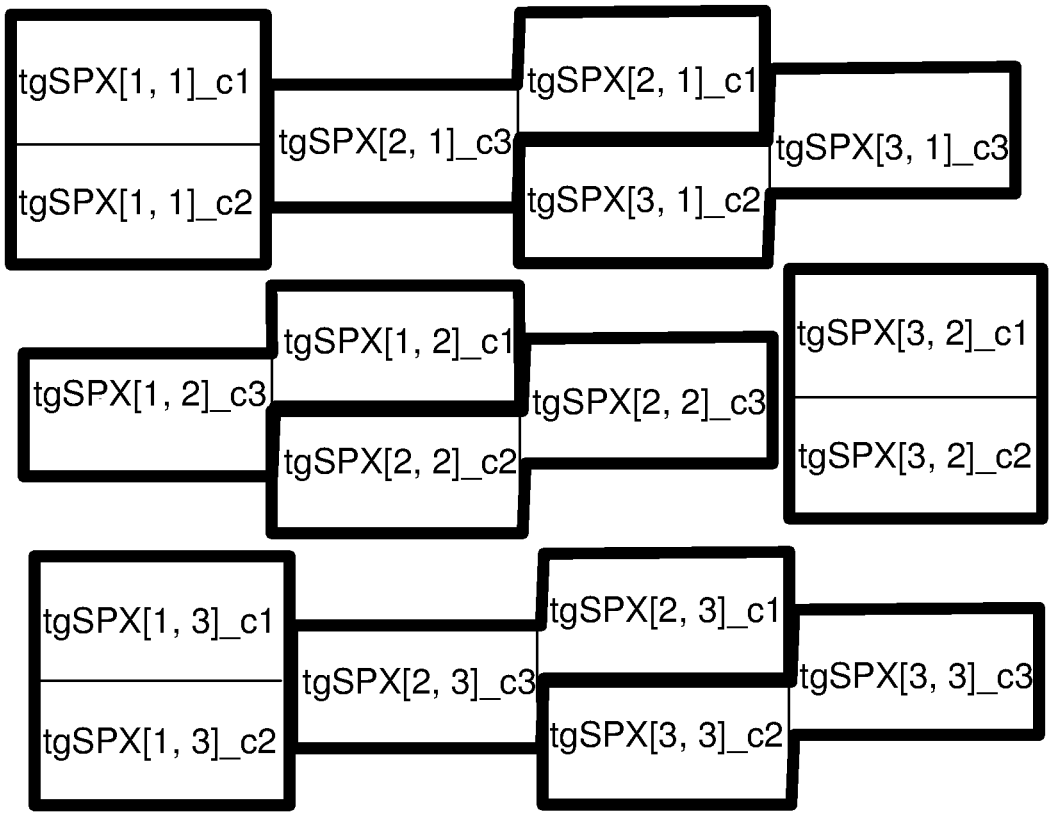
FIG. 20 is a schematic diagram illustrating pixel definitions of the display shown in FIG. 18.

FIG. 20 is a schematic diagram showing the subpixel layout of the target region TR shown in FIG. 18. Based on the three types of pixels defined in FIG. 19A, 19B, 19C, the pixels shown in FIG. 18 can be considered as a target region TR including 3×3 target pixels. In practical application, the display panel having the subpixel layout shown in FIG. 20 may be used to display the selected region SR shown in FIG. 8.

Figure 21:
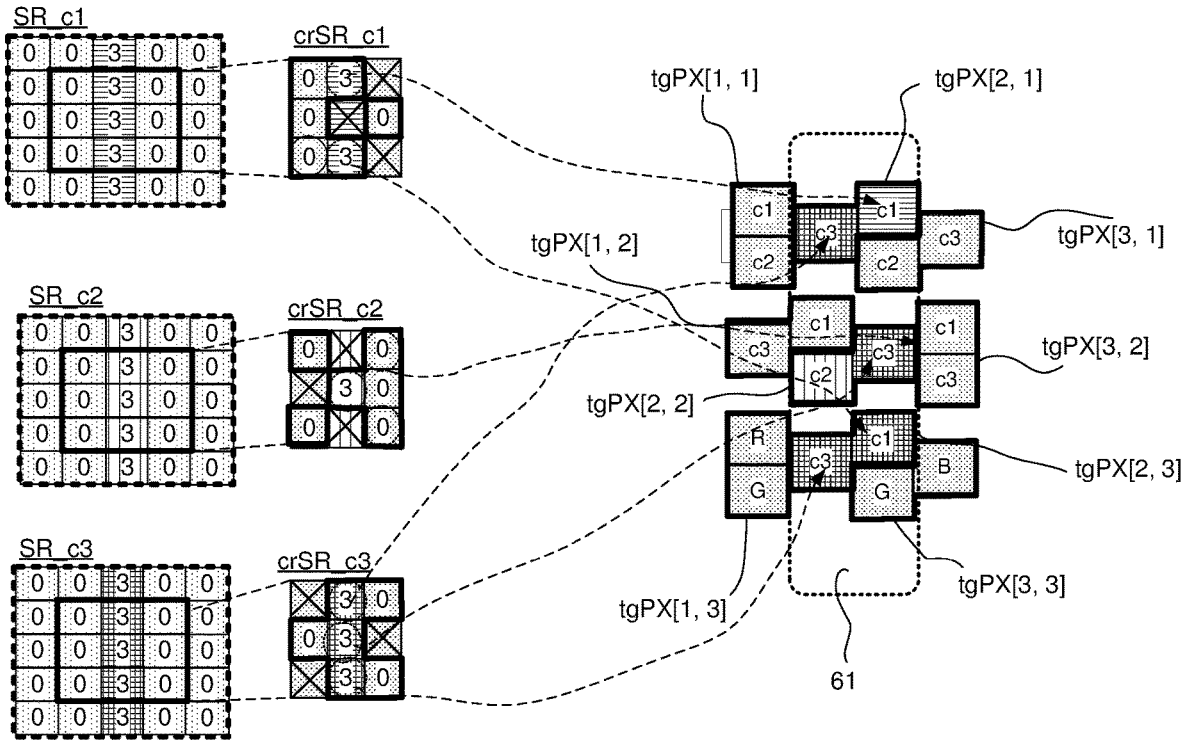
FIG. 21 is a schematic diagram illustrating the subpixels located in the vertical stripe display zone but not displaying.

FIG. 21 is a schematic diagram illustrating the display effect when the direct mapping is applied to the subpixel layout in FIG. 20. Details about generating the rendered subpixel data based on the selected regions SR_c1, SR_c2, SR_c3 and the selection of the core areas crSR_c1, crSR_c2, crSR_c3, and mapping between the rendered subpixel data to the target subpixels tgSPX[1,1]-tgSPX[3, 3] are omitted to avoid redundancy. As each of the pixels has one subpixel missing, not all the input points (inPT_c1, inPT_c2, inPT_c3) in the selected region SR_c1, SR_c2, SR_c3 are used as core elements in FIG. 21.

For the red color-plane IMGin_c1, none of the input points (inPT(3, 1)_c1, inPT(2,2)_c1, and inPT(3, 3)_c1) is selected as a red core element for the convolution operation because none of the target pixels tgPX[3, 1], tgPX[2, 2], and tgPX[3, 3] includes a red target subpixel tgSPX[a, b]_c1. Therefore, the core area (crSR_c1) includes 6 red input points (inPT_c1), and the boundary area bdrySR_c1 includes 19 red input points (inPT_c1). The red target subpixels tgSPX[1,1]_c1, tgPX[2, 1]_c1, tgPX[1, 2]_c1, tgPX[3, 2], tgPX[1,3]_c1, and tgPX[2, 3]_c1 receive the rendered subpixel data sprD{1,1}_c1, sprD{2,1}_c1, sprD{1,2}_c1, sprD{3, 2}, sprD{1, 3}_c1, and spr{2, 3}_c1, respectively. In FIG. 21, 6 red target subpixels (tgSPX[a, b] _c1) respectively receive their corresponding red rendered subpixel data (sprD{x, y}_c1) and two of the red target subpixels (tgSPX[a, b] _c1) are located at the vertical stripe display zone 61.

For the green color-plane IMGin_c2, none of the input points (inPT(2, 1)_c2, inPT(1,2)_c2, and inPT(2, 3)_c2) is selected as a green core element for the convolution operation because none of the target pixels tgPX[2, 1], tgPX[1, 2], and tgPX[2, 3] includes a green subpixel SPX_c2. Therefore, the core area (SR_c1) includes 6 green input points (inPT_c2), and the boundary area bdrySR_c2 includes 19 green input points (inPT_c2). The green target subpixels tgSPX[1,1]_c2, tgSPX[3, 1]_c2, tgSPX[2, 2]_c2, tgSPX[3, 2]_c2, tgSPX[1, 3] and tgSPX[3, 3]_c2 receive the rendered subpixel data sprD{1,1}c2, sprD{3,1}_c2, sprD {2,2}c2, sprD{3, 2}c2, sprD{3, 1}_c2 and sprD{3, 3}_c2, respectively. In FIG. 21, 6 green target subpixels (tgSPX[a, b]_c2) receive the green rendered subpixel data (sprD{x, y}c2) and one of which is located at the vertical stripe display zone 61.

For the blue color-plane IMGin_c3, none of the input points (inPT(1, 1)_c3, inPT(3, 2)_c3, and inPT(1, 3)_c3) is selected as a blue core element for the convolution operation because none of the target pixels tgSPX[1, 1], tgSPX[3, 2], and tgSPX[1, 3] includes a blue target subpixel tgSPX[a, b]_c3. Therefore, the core area crSR_c3 includes 6 blue input points (inPT_c3), and the boundary area bdrySR_c1 includes 17 blue input points (inPT_c3). The blue target subpixels tgSPX[2,1]_c3, tgSPX[1, 2]_c3, tgSPX[2, 2]_c3 and tgSPX[2,3]_c3 receive the rendered subpixel data sprD{2, 1}_c3, sprD{1, 2}_c3, sprD{2, 2}_c3, and sprD{2, 3}_c3, respectively. In FIG. 21, 6 blue target subpixels (tgSPX[a, b] _c3) receive the blue rendered subpixel data (sprD{x, y}c3), and three of which are located at the vertical stripe display zone 61.

Based on the above illustration, the vertical stripe display zone includes two red target subpixels tgSPX[a, b]_c1, one green target subpixel tgSPX[a, b]_c2, and three blue target subpixels tgSPX[a, b]_c3. In other words, the number of the blue target subpixels tgSPX[a, b]_c3 whose rendered subpixel data sprD_c3 have non-zero values is greater than the number of the red target subpixels tgSPX[a, b]_c1 whose rendered subpixel data sprD_c1 have non-zero values, and the number of the red target subpixels tgSPX[a, b]_c1 whose rendered subpixel data sprD_c1 have non-zero values is higher than the number of the green target subpixels tgSPX [a, b]_c2 whose rendered subpixel data sprD_c2 have non-zero values. Because the number of the red target subpixels tgSPX[a, b]_c1, the target green subpixels tgSPX[a, b]_c2, and the blue target subpixels tgSPX[a, b]_c3 located in the vertical stripe display zone 61 are not equivalent, the white-color vertical stripe cannot be accurately displayed.

Alternative speaking, the white vertical stripe cannot be appropriately displayed because some of the target subpixels tgSPX located in the vertical stripe display zone 61 do not receive the rendered subpixel data sprD. As shown in FIG. 21, the target subpixels tgSPX located in the vertical stripe display zone 61 but not displaying include the green target subpixel (tgSPX [3, 1]_c2), the red target subpixel (tgSPX [2, 2]_c2), and the green target subpixel (tgSPX [3, 3]_c2).

Figure 22A:
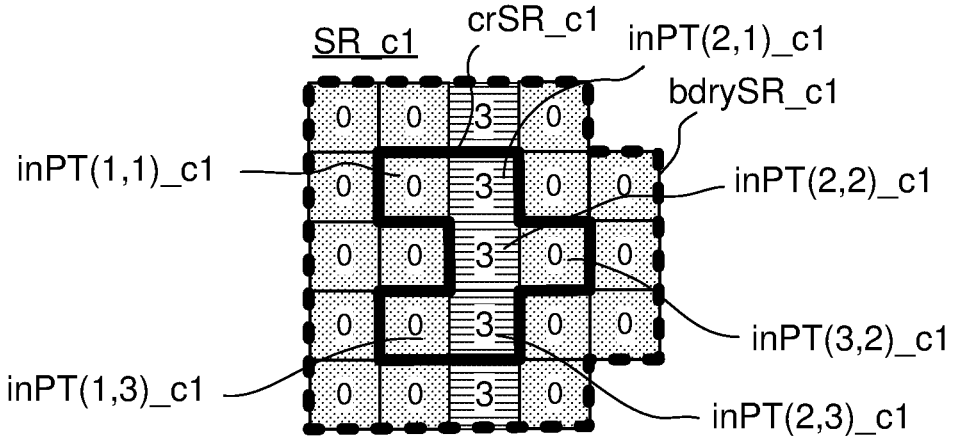
FIGS. 22A, 22B, and 22C are schematic diagrams illustrating the selected region in different color-planes based on the coordinate shifting approach according to the embodiment of the present disclosure.
Figure 22B:
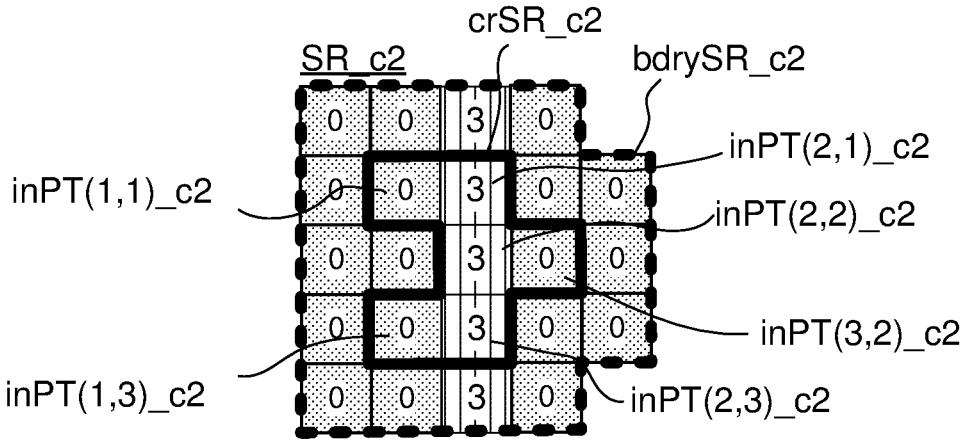
Figure 22C:
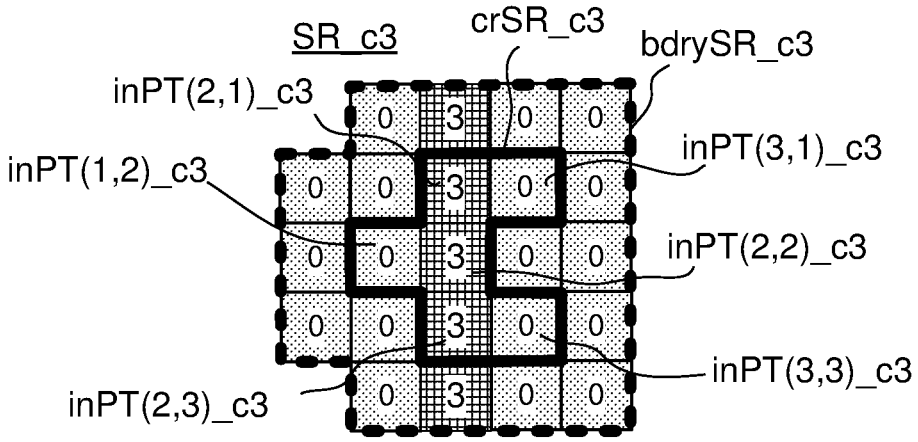

FIGS. 22A, 22B, and 22C are schematic diagrams illustrating the selected region in different color-planes based on the coordinate shifting approach according to the embodiment of the present disclosure.

Comparing to the core area crSR_c1 in FIG. 21, the core area crSR_c1 in FIG. 22A excludes the red input point (inPT(1, 2)_c1) as the core element, but further includes the red input point (inPT(2, 2)_c1) as the core element. The core area crSR_c1 includes 6 red input points (inPT(1, 1)_c1, inPT(2, 1)_c1, inPT(2, 2)_c1, inPT(3, 2)_c1, inPT(1, 3)_c1, inPT(2, 3)_c1), and the boundary area bdrySR_c1 includes 17 red input points (inPT_c1). The convolution operations of the red sampling matrixes (inDS_c1) centered at different red input points inPT_c1 within the core area crSR_c1 and the green filter kernel FMx_c1 are respectively calculated to generate the red rendered subpixel data sprD{1, 1}_c1, sprD{2, 1}_c1, sprD{2, 2}_c1, sprD{3, 2}_c1, sprD{1, 3}_c1, sprD{2, 3}_c1.

Comparing to the core area (crSR_c2) in FIG. 21, the core area (crSR_c2) in FIG. 22B excludes the green input points (inPT(3,1)_c2, inPT(3, 3)_c2) as the core element, but further includes the green input points (inPT(2,1)_c2, inPT (2, 3)_c2) as the core elements. The core area (crSR_c2) includes 6 green input points (inPT(1, 1)_c2, inPT(2, 1)_c2, inPT(2, 2)_c2, inPT(3, 2)_c2, inPT(1, 3)_c2, inPT(2, 3)_c2), and the boundary area (bdrySR_c2) includes 17 green input points. The convolution operations of the green sampling matrixes (inDS_c2) centered at different green input points inPT_c2 within the core area crSR_c2 and the green filter kernel FMx_c2 are respectively calculated to generate the green rendered subpixel data sprD{1, 1}_c2, sprD{2, 1}_c2, sprD{2, 2}_c2, sprD{3, 2}_c2, sprD{1, 3}_c3, sprD{2, 3}_c2.

The core areas (crSR_c3) in FIGS. 21 and 22C are identical. Therefore, the core elements acquired in the blue color-plane IMGin_c3 remain unchanged. The core area crSR_c3 includes 6 blue input points (inPT(2, 1)_c3, inPT (3, 1)_c3, inPT(1, 2)_c3, inPT(2, 2)_c3, inPT(2, 3)_c3, inPT(3, 3)_c3), and the boundary area bdrySR_c3 includes 17 blue input points. The convolution operations of the blue sampling matrixes (inDS_c3) centered at different blue input points inPT_c3 within the core area crSR_c3 and the blue filter kernel FMx_c3 are respectively calculated to generate the blue rendered subpixel data sprD{2, 1}_c3, sprD{3, 1}_c3, sprD{1, 2}_c3, sprD{2, 2}_c3, sprD{2, 3}_c3, sprD{3, 3}_c3.

Please compare FIGS. 22A, 22B, and 22C together. The layout of the red input points inPT(x, y)_c1 in the core area csSR_c1 and the layout of the green input points inPT(x, y)_c2 in the core area csSR_c2 are the same. However, the layout of the blue input points inPT(x, y)_c3 in the core area crSR_c3 is different from the others. Moreover, number of the red, green, blue input points inPT(x, y)_c1, inPT(x, y)_c2, inPT(x, y)_c3 respectively in the core area csSR_c1, csSR_c2, csSR_c3 are equivalent to each other (that is, 6, as shown in FIGS. 22A, 22B, 22C) but different from the number of the target pixels tgPX[a, b] (that is, 9, as shown in FIG. 20).

FIGS. 23A, 23B, and 23C are schematic diagrams illustrating the generation of the red rendered subpixel data set sprDSET_c1 and mapping the red rendered subpixel data to the red target subpixels tgSPX[a, b]_c1 according to the embodiment of the present disclosure. The matrixes circulated by the dotted line at the left side of FIG. 23A are the red sampling matrixes (inDS{1, 1}_c1, inDS{2, 1}_c1, inDS{2, 2}_c1, inDS{3, 2}_c1, inDS{1, 3}_c1, inDS{2, 3}c1), which can be obtained by selecting the core elements (inPT(1, 1)_c1, inPT(2, 1)_c1, inPT(2, 2)_c1, inPT(3, 2)_c1, inPT(1, 3)_c1, inPT(2, 3)_c1) in FIG. 22A, and the matrixes circulated by the dotted line at the right side of FIG. 23A are the red filter kernels (FMx{1, 1}_c1, FMx{2,1}_c1, FMx{2, 2}c1, FMx{3, 2}c1, FMx{1, 3}_c1, FMx{2,3}_c1). The red sampling matrixes inDS{x, y}_c1 and the red filter kernels FMx{x, y}c1 are listed in accordance with the relative positions of the core elements inPT(x, y)_c1 in the core area crSR_c1.

By respectively performing the convolution operation to the red sampling matrixes (inDS{1, 1}_c1, inDS{2, 1}_c1, inDS{(2, 2)_c1, inDS{3, 2}_c1, inDS{1, 3}_c1, inDS{2, 3}c1) with the red filter kernel FMx_c1, the red rendered subpixel data set sprDSET_c1 (as shown in FIG. 23B) including red rendered subpixel data sprD{1, 1}_c1, sprD(2, 1)_c1, sprD{2, 2}_c1, sprD{3, 2}_c1, sprD{1, 3}_c1, sprD{2, 3}_c1 can be obtained. As the red rendered subpixel data set sprDSET_c1 is generated by performing the convolution operation being centered with each of the red core elements, the number and layout of the red rendered subpixel data (sprD{1, 1}_c1, sprD{2, 1}_c1, sprD{2, 2}_c1, sprD(3, 2)_c1, sprD{1, 3}_c1, sprD{2, 3}_c1) are to the same as those of the red core elements. The relationships and comparisons between the rendered subpixel data (sprD{1, 1}_c1, sprD{2, 1}_c1, sprD{2, 2}_c1, sprD{3, 2}_c1, sprD{1, 3}_c1, sprD{2, 3}_c1) and red target subpixels (tgSPX[1, 1]_c1, tgSPX[2, 1]_c1, tgSPX[1, 2]_c1, tgSPX[3, 2]_c1, tgSPX[1, 3]_c1, tgSPX[2, 3]_c1) are shown in FIG. 23C and summarized in Table 4.

TABLE 4

| coordinate of red input point inPT(x, y)_c1 | coordinate of red rendered subpixel data sprD{x, y}_c1 | coordinate of red target subpixel tgSPX[a, b]_c1 | horizontal coordinate shift parameter Δx_c1 | vertical coordinate shift parameter Δy_c1 |
|---|---|---|---|---|
| (1, 1) | {1, 1} | [1, 1] | 0 | 0 |
| (2, 1) | {2, 1} | [2, 1] | 0 | 0 |
| (3, 1) | NA | NA | NA | NA |
| (1, 2) | NA | NA | NA | NA |
| (2, 2) | {2, 2} | [1, 2] | −1 | 0 |
| (3, 2) | {3, 2} | [3, 2] | 0 | 0 |
| (1, 3) | {1, 3} | [1, 3] | 0 | 0 |
| (2, 3) | {2, 3} | [2, 3] | 0 | 0 |
| (3, 3) | NA | NA | NA | NA |

As shown in FIG. 20, target pixels tgPX[3,1], tgPX[2,2], tgPX[3, 3] do not have red target subpixel). Therefore, not all the red input points inPT(x, y)_c1 (x=1~3, y=1~3) in the core area crSR_c1 are utilized as the red core elements. For the existing red target subpixels, coordinates of some but not all of the red target subpixels tgSPX[a, b]_c1 and coordinates of their corresponding red rendered subpixel data spr{x, y}_c1 are matched (that is, a=x, b=y). In contrast, coordinates of one of the existing red target subpixels tgSPX[a, b]_c1 and coordinates of its corresponding red rendered subpixel data spr{x, y}_c1 are inconsistent (that is, a=x−1, b=y).

For example, the red target subpixels tgSPX[1, 1]c, tgSPX[2, 1]_c1, tgSPX[3, 2]_c1, tgSPX[1, 3]_c1, tgSPX[2, 3]_c1 respectively acquire the red rendered subpixel data sprD{1, 1}_c1, sprD{2, 1}_c1, sprD{3, 2}_c1, sprD{1, 3}_c2 sprD{2, 3}_c2 to determine their luminances. Coordinates of the red target subpixels tgSPX[a, b] and coordinates of the rendered subpixel data sprD{x, y}_c1 are matched. That is, a=x and b=y. On the other hand, the red target subpixel tgSPX[1, 2]_c1 acquires the red rendered subpixel datum sprD{2, 2}_c2 for determining its luminance, not the red rendered subpixel data sprD{1, 2}_c1. Alternatively speaking, a horizontal coordinate shift parameter of "Δx_c1=−1" should be applied to the horizontal coordinate of the red input point inPT(x, y)_c1 when x=2 and y=2.

Figure 24A:
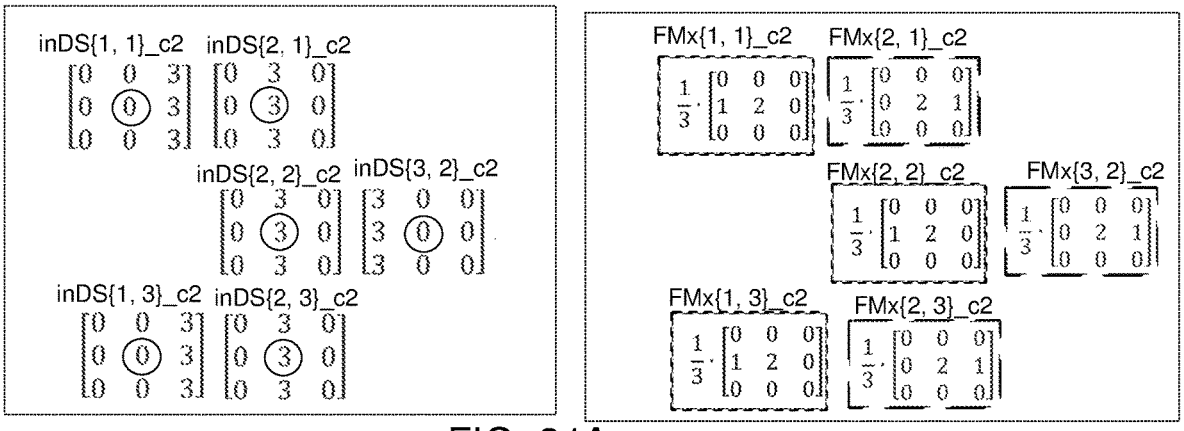
FIGS. 24A, 24B, and 24C are schematic diagrams illustrating the generation of the green rendered subpixel data set sprDSET_c2 and mapping the green rendered subpixel data to the green target subpixels tgSPX[a, b]_c2 according to the embodiment of the present disclosure.
Figure 24B:
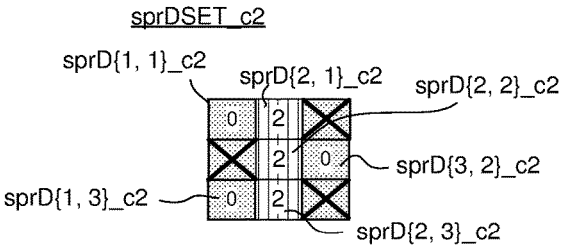
Figure 24C:
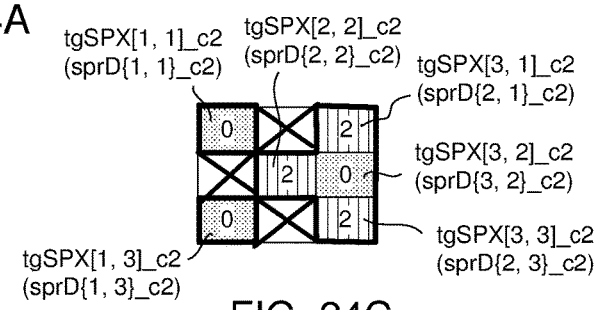

FIGS. 24A, 24B, and 24C are schematic diagrams illustrating the generation of the green rendered subpixel data set sprDSET_c2 and mapping the green rendered subpixel data to the green target subpixels tgSPX[a, b]_c2 according to the embodiment of the present disclosure. The matrixes circulated by the dotted line at the left side of FIG. 24A are the green sampling matrixes (inDS{1, 1}c2, inDS{2, 1}_c2, inDS{2, 2}_c2, inDS{3, 2}_c2, inDS{1, 3}_c2, inDS{2, 3}_c2), which can be obtained by selecting the core elements (inPT(1, 1)_c2, inPT(2, 1)_c2, inPT(2, 2)_c2, inPT(3, 2)_c2, inPT(1, 3)_c2, inPT(2, 3)_c2) in FIG. 22B, and the matrixes circulated by the dotted line at the right side of FIG. 24A are the green filter kernels (FMx{1, 1}_c2, FMx{2, 1}_c2, FMx{2,2}_c2, FMx{3, 2}_c2, FMx{1, 3}_c2, FMx{2,3}_c2). The green sampling matrixes inDS{x, y}_c2 and the green filter kernels FMx{x, y}_c2 are listed in accordance with the relative positions of the core elements inPT(x, y)_c2 in the core area crSR_c2.

By respectively performing the convolution operation to the green sampling matrixes inDS{1, 1}_c2, inDS{2, 1}_c2, inDS{2, 2}_c2, inDS{3, 2}_c2, inDS{1, 3}_c2, inDS{2, 3}_c2 with the green filter kernel FMx_c2, the green rendered subpixel data set sprDSET_c2 (as shown in FIG. 24B) including green rendered subpixel data sprD{1, 1}_c2, sprD{2, 1}_c2, sprD{2, 2}_c2, sprD{3, 2}_c2, sprD{1, 3}_c2, sprD{2, 3}_c2) can be obtained. As the green rendered subpixel data set sprDSET_c2 is generated by performing the convolution operation being centered with the green core elements, the number and layout of the green rendered subpixel data (sprD{1, 1}_c2, sprD{2, 1}_c2, sprD{2, 2}_c2, sprD{3, 2}_c2, sprD{1, 3}_c2, sprD{2, 3}_c2) are the same as those of the green core elements. The relationships and comparisons between the rendered subpixel data (sprD{1, 1}_c2, sprD{2, 1}_c2, sprD{2, 2}_c2, sprD{3, 2}_c2, sprD{1, 3}_c2, sprD{2, 3}_c2) and the red target subpixels (tgSPX[1, 1]_c2, tgSPX[2, 1]_c2, tgSPX[1, 2]_c2, tgSPX[3, 2]_c2, tgSPX[1, 3]_c2, tgSPX[2, 3]_c2) are shown in FIG. 24C and summarized in Table 5.

TABLE 5

| coordinate of green input point inPT(x, y)_c2 | coordinate of green rendered subpixel data sprD{x, y}_c2 | coordinate of green target subpixel tgSPX[a, b]_c2 | horizontal coordinate shift parameter Δx_c2 | vertical coordinate shift parameter Δy_c2 |
|---|---|---|---|---|
| (1, 1) | {1, 1} | [1, 1] | 0 | 0 |
| (2, 1) | {2, 1} | [3, 1] | +1 | 0 |
| (3, 1) | NA | NA | NA | NA |
| (1, 2) | NA | NA | NA | NA |
| (2, 2) | {2, 2} | [2, 2] | 0 | 0 |
| (3, 2) | {3, 2} | [3, 2] | 0 | 0 |
| (1, 3) | {1, 3} | [1, 3] | 0 | 0 |
| (2, 3) | {2, 3} | [3, 3] | +1 | 0 |
| (3, 3) | NA | NA | NA | NA |

As shown in FIG. 20, target pixels tgPX[2,1], tgPX[1,2], tgPX[2, 3] do not have green target subpixels. Therefore, not all the green input points inPT(x, y)_c2 (x=1~3, y=1~3) in the core area crSR_c2 are utilized as the green core elements. For the existing green target subpixels, coordinates of some of the existing green target subpixels tgSPX[a, b]_c2 are consistent with coordinates of their corresponding green rendered subpixel data spr{x, y}_c2 (that is, a=x, b=y). In contrast, coordinates of two of the existing green target subpixels tgSPX[a, b]_c2 and coordinates of their corresponding green rendered subpixel data spr{x, y}_c2 are inconsistent (that is, a=x+1, b=y).

For example, the green target subpixels tgSPX[1, 1]_c2, tgSPX[2, 2]_c2, tgSPX[3, 2]_c2, tgSPX[1, 3]_c2 respectively acquire the green rendered subpixel data sprD{1, 1}_c2, sprD{2, 2}_c2, sprD{3, 2}_c2 and sprD{1, 3}_c2 to determine their luminances. Coordinates of the green target subpixels tgSPX[a, b]_c2 and coordinates of the green rendered subpixel data sprD{x, y}_c2 are matched. That is, a=x and b=y. On the other hand, the green target subpixel tgSPX[3, 1]_c2, tgSPX[3, 3]_c2 respectively acquire the green rendered subpixel data sprD{2, 1}_c2, sprD{2, 3}_c2 for determining their luminances, not the green rendered subpixel data sprD{3, 1}_c2, sprD{3, 3}_c2. Alternatively speaking, a horizontal coordinate shift parameter of "Δx_c2=+1" should be applied to the horizontal coordinate of the green input point inPT(x, y)_c2 when x=2 and y=1, or when x=2 and y=3.

Figure 25A:
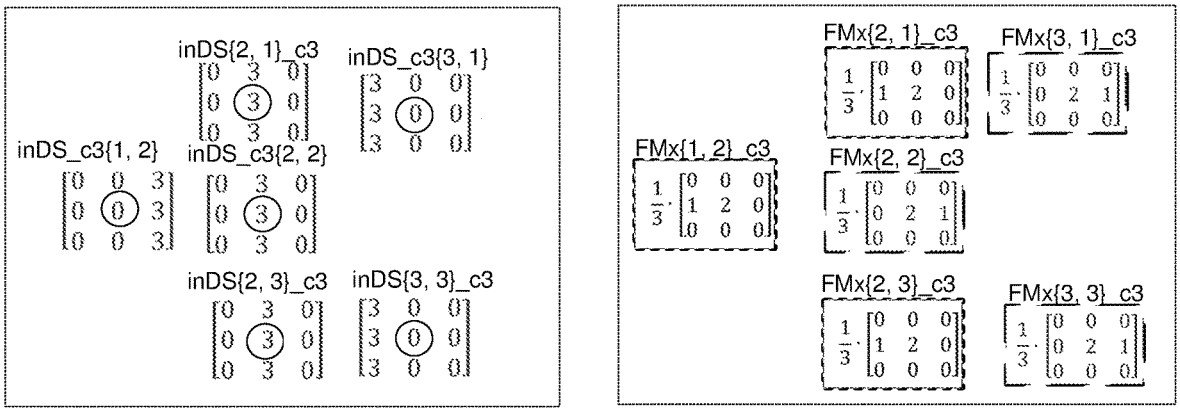
FIGS. 25A, 25B, and 25C are schematic diagrams illustrating the generation of the blue rendered subpixel data set sprDSET_c3 and mapping the blue rendered subpixel data to the blue target subpixels tgSPX[a, b]_c3 according to the embodiment of the present disclosure.
Figure 25B:
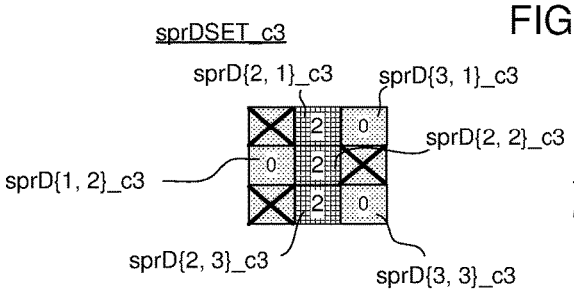
Figure 25C:
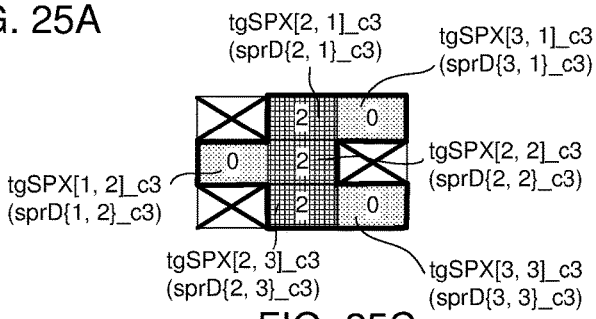

FIGS. 25A, 25B, and 25C are schematic diagrams illustrating the generation of the blue rendered subpixel data set sprDSET_c3 and mapping the blue rendered subpixel data to the blue target subpixels tgSPX[a, b]_c3 according to the embodiment of the present disclosure. The matrixes circulated by the dotted line at the left side of FIG. 25A are the blue sampling matrixes (inDS{2, 1}_c3, inDS{3, 1}_c3, inDS{1, 2}_c3, inDS{2, 2}_c3, inDS{2, 3}_c3, inDS{3, 3}_c3), which can be obtained by selecting the core elements (inPT(2, 1)_c3, inPT(3, 1)_c3, inPT(1, 2)_c3, inPT(2, 2)_c3, inPT(2, 3)_c3, inPT(3, 3)_c3) in FIG. 22C, and the matrixes circulated by the dotted line at the right side of FIG. 25A are the blue filter kernels (FMx{2, 1}_c3, FMx{3, 1}_c3, FMx{1,2}_c3, FMx{2, 2}_c3, FMx{2, 3}_c3, FMx{3,3}_c3). The blue sampling matrixes inDS{x, y}c3 and the blue filter kernels FMx{x, y}_c3 are listed in accordance with the relative positions of the core elements inPT(x, y)_c3 in the core area crSR_c3.

By respectively performing the convolution operation to the blue sampling matrixes (inDS{2, 1}_c3, inDS{3, 1}_c3, inDS{1, 2}_c3, inDS{2, 2}_c3, inDS{2, 3}_c3, inDS{3, 3}_c3) with the blue filter kernels FMx_c3, the blue rendered subpixel data set sprDSET_c3 (as shown in FIG. 25B) including the blue rendered subpixel data (sprD{2, 1}_c3, sprD{3, 1}_c3, sprD{1, 2}_c3, sprD{2, 2}_c3, sprD{2, 3}_c3, sprD{3, 3}_c3) can be obtained. As the blue rendered subpixel data set sprDSET_c3 is generated by respectively performing the convolution operation being centered with each of the blue core elements, the number and layout of the blue rendered subpixel data (sprD{2, 1}_c3, sprD(3, 1)_c3, sprD{1, 2}_c3, sprD{2, 2}_c3, sprD{2, 3}_c3, sprD{3, 3}_c3) are the same as those of the blue core elements. The relationships and comparisons between the rendered subpixel data (sprD{2, 1}_c3, sprD{3, 1}_c3, sprD{1, 2}_c3, sprD{2, 2}_c3, sprD{2, 3}_c3, sprD{3, 3}_c3) and the blue target subpixels (tgSPX[2, 1]_c3, tgSPX[3, 1]_c3, tgSPX[1, 2]_c3, tgSPX[2, 2]_c3, tgSPX[2, 3]_c3, tgSPX[3, 3]_c3) are shown in FIG. 25C and summarized in Table 6.

TABLE 6

| coordinate of blue input point inPT(x, y)_c3 | coordinate of blue rendered subpixel data sprD{x, y}_c3 | coordinate of blue target subpixel tgSPX[a, b]_c3 | horizontal coordinate shift parameter Δx_c3 | vertical coordinate shift parameter Δy_c3 |
|---|---|---|---|---|
| (1, 1) | NA | NA | NA | NA |
| (2, 1) | {2, 1} | [2, 1] | 0 | 0 |
| (3, 1) | {3, 1} | [3, 1] | 0 | 0 |
| (1, 2) | {1, 2} | [1, 2] | 0 | 0 |
| (2, 2) | {2, 2} | [2, 2] | 0 | 0 |
| (3, 2) | NA | NA | NA | NA |
| (1, 3) | NA | NA | NA | NA |
| (2, 3) | {2, 3} | [2, 3] | 0 | 0 |
| (3, 3) | {3, 3} | [3, 3] | 0 | 0 |

As shown in FIG. 20, target pixels tgPX[1,1], tgPX[3,2], tgPX[3, 1] do not have blue target subpixels). Therefore, not all the blue input points inPT(x, y)_c3 (x=1~3, y=1~3) in the core area crSR_c3 are utilized as the blue core elements. For all the existing blue target subpixels, their coordinates are consistent with coordinates of their corresponding blue rendered subpixel data spr{x, y}c3 (that is, a=x, b=y). Alternatively speaking, the coordinate shift parameter is not required for the blue color-plane IMGin_c3.

Please refer to FIGS. 23A, 24A, and 25A together. In FIGS. 23A, 24A, and 25A, two types of rendering convolution matrixes are used, that is $$\frac{1}{3}\cdot\begin{bmatrix}0&0&0\\1&2&0\\0&0&0\end{bmatrix}\text{ and }\frac{1}{3}\cdot\begin{bmatrix}0&0&0\\0&2&1\\0&0&0\end{bmatrix}.$$

The uses of the rendering convolution matrixes are summarized in Table 7.

TABLE 7

| rendering convolution matrix | red filter kernels | green filter kernels | blue filter kernels |
|---|---|---|---|
| $\frac{1}{3}\cdot\begin{bmatrix}0&0&0\\1&2&0\\0&0&0\end{bmatrix}$ | FMx{1,1}_c1, FMx{2,2}_c1, FMx{1,3}_c1 | FMx{1,1}_c2, FMx{2,2}_c2, FMx{1,3}_c2 | FMx{2,1}_c3, FMx{1,2}_c3, FMx{2,3}_c3 |
| $\frac{1}{3}\cdot\begin{bmatrix}0&0&0\\0&2&1\\0&0&0\end{bmatrix}$ | FMx{2,1}_c1, FMx{3,2}_c1, FMx{2,3}_c1 | FMx{2,1}_c2, FMx{3,2}_c2, FMx{2,3}_c2 | FMx{3,1}_c3, FMx{2,2}_c3, FMx{3,3}_c3 |

As listed in Table 7, the two rendering convolution matrixes can be repetitively used in the convolution operations for the input points in different color-planes IMGin_c1, IMGin_c2, IMGin_c3. Therefore, the storage space required by the filter portion 355 in the memory 35 can be decreased dramatically.

Figure 26A:
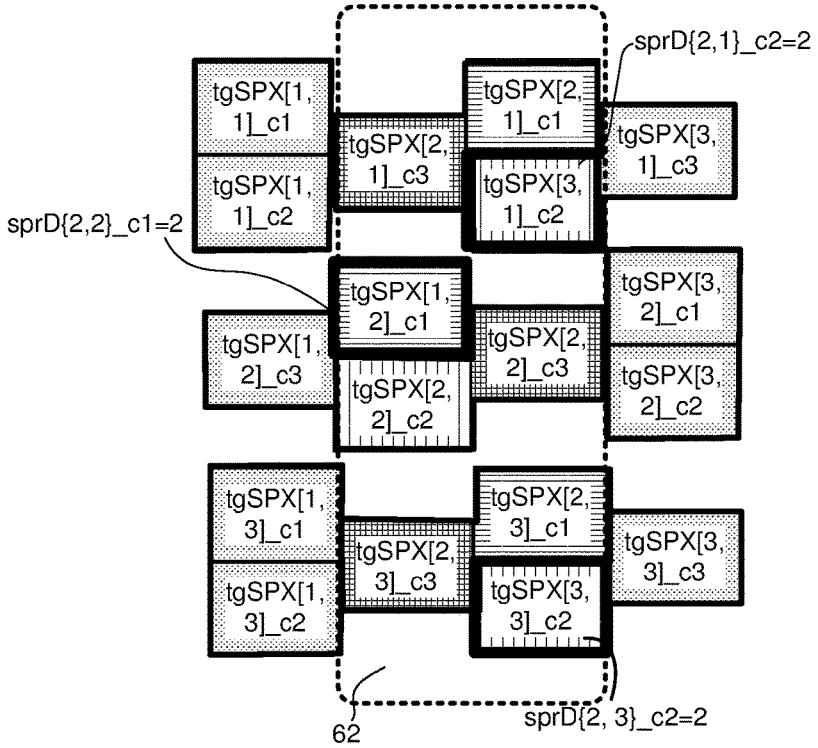
FIGS. 26A and 26B are schematic diagrams illustrating the mapping between the rendered subpixel data and the subpixels of the target pixels.

FIG. 26A is a schematic diagram illustrating mapping between the rendered subpixel data and the subpixels of the target pixels. The red, green, and blue target subpixels respectively shown in FIGS. 23C, 24C, and 25C are combined together in FIG. 26A.

Please refer to FIGS. 21 and 26A together. In FIG. 21, the green target subpixel tgSPX[3, 1]_c2 does not receives its rendered subpixel data, the red target subpixel tgSPX[1, 2]_c1 does not receive its rendered subpixel data, nor the green target subpixel tgSPX[3, 3]_c2 receives its rendered subpixel data, and the white vertical stripe cannot be displayed appropriately. Relatively, in FIG. 26A, all the 9 target subpixels located at the vertical stripe display zone 62, that is, target subpixels tgSPX[2, 1]_c1, tgSPX[2, 1]_c3, tgSPX[3, 1]_c2, tgSPX[1, 2]_c1, tgSPX[2, 2]_c3, tgSPX[2, 2]_c2, tgSPX[2, 3]_c1, tgSPX[2, 3]_c3, tgSPX[3, 3]_c2, can receive their corresponding rendered subpixel data, and the white vertical stripe can be displayed appropriately.

In FIG. 26A, the green target subpixel tgSPX[3, 1]_c2 (a=3 and b=1) displays the rendered subpixel datum sprD{x, y}c2 (x=2 and y=1), not the green rendered subpixel datum sprD{3, 1}_c2 (x=3 and y=1). A horizontal coordinate difference in the green color-plane (Δx_c2=a−x=1) exists between horizontal coordinates of the green target subpixel tgSPX[3, 1]_c2 (a=3) and the green input point inPT(2, 1)_c2 (x=2).

The red target subpixel tgSPX[1, 2]_c1 (a=1 and b=2) displays the red rendered subpixel datum sprD{x, y}_c1 (x=2 and y=2), no the red rendered subpixel datum sprD{1, 2}_c1 (x=1 and y=2). A horizontal coordinate difference in the red color-plane (Δx_c1=a−x=−1) exists between horizontal coordinates of the red target subpixel tgSPX[1, 2]_c1 (a=1 and b=2) and the red input point inPT(2, 2)_c1 (x=2 and y=2).

The green target subpixel tgPX[3, 3]_c2 (a=3 and b=3) displays the rendered subpixel datum sprD{2, 3}c2 (x=2 and y=3), not the green rendered subpixel datum sprD{3, 3}_c2 (x=3 and y=3). A horizontal coordinate difference in the green color-plane (Δx_c1=a−x=1) exists between horizontal coordinates of the green target subpixel tgSPX[3, 3]_c2 (a=3 and b=3) and the green input point inPT(2, 3)_c2 (x=2 and y=3).

According to the embodiment of the present disclosure, the horizontal coordinate differences (a−x) in different color-planes can truly reflect the physical layout of the subpixels, and the horizontal coordinate differences (a−x) in different color-planes are utilized as the coordinate shift parameter(s) and stored at the coordinate portion 351. Consequentially, the image processing related operations used to consider separately for the three different color-planes IMGin_c1, IMGin_c2, IMGin_c3 in the conventional approach, now only need to consider for one unified calculation, which can be applied to all the three different color-planes IMGin_c1, IMGin_c2, IMGin_c3.

Similarly, in a case that the vertical coordinate differences (b−y) exist, the image processing related operations can be simplified. The horizontal coordinate differences (a−x) and the vertical coordinate differences (b−y) are considered as the coordinate shift parameter(s). This is, use of the coordinate shift parameter(s) can make up (compensate) the layout inconsistency of the red, the green, and the blue target subpixels tgSPX[a, b]_c1, tgSPX[a, b]_c2, tgSPX[a, b]_c3.

Figure 26B:
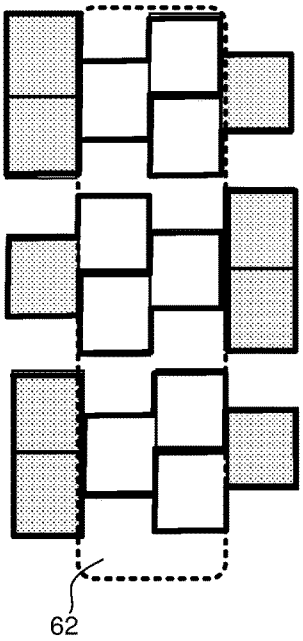

FIG. 26B shows the display results of FIG. 26A in an intuitive way. As shown in FIG. 26B, all the target subpixels located at the vertical stripe display zone 62 receive their rendered subpixel data, and the white vertical stripe can be correctly displayed.

Figure 28:
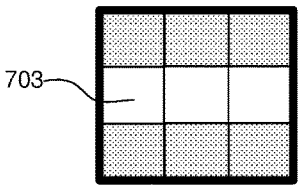
FIG. 28 is a schematic diagram showing a white horizontal stripe.

FIG. 27 is a top view diagram illustrating another exemplary pixel layout of an OLED display panel. In FIG. 27, the subpixels are aligned in row direction but not aligned in a column direction. FIG. 28 is a schematic diagram showing a white horizontal stripe 703.

Figure 29:
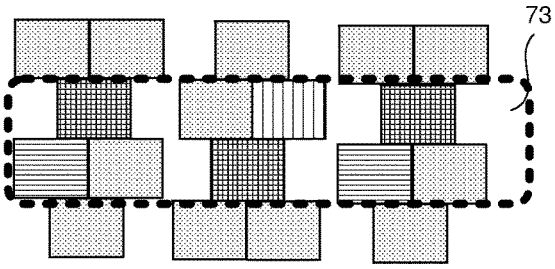
FIG. 29 is a schematic diagram illustrating the display effects of the display showing the white horizontal stripe according to the direct mapping.

FIG. 29 is a schematic diagram illustrating the display effects of the display showing the white horizontal stripe according to the direct mapping. When only the direct mapping is used, the horizontal stripe display zone 73 cannot display the white horizontal stripe 703 appropriately.

Figure 30:
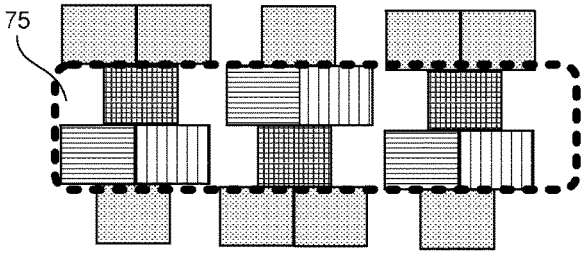
FIG. 30 is a schematic diagram illustrating the display effects of the display showing the horizontal stripe based on the coordinate shifting method according to the embodiment of the present disclosure.

FIG. 30 is a schematic diagram illustrating the display effects of the display showing the horizontal stripe based on the coordinate shifting method according to the embodiment of the present disclosure. In a case that the coordinate shifting method is used, the horizontal stripe display zone 75 can display the white horizontal stripe appropriately.

In the specification, the SPR circuit considers the physical subpixel layout of the display panel while performing the subpixel rendering. The embodiments demonstrate that the content in the input image IMGin can be correctly displayed when the coordinate mapping function is adopted.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A display control circuit, applied to transform a plurality of input points of an input image to a plurality of target subpixels of a display panel, wherein the input points have at least a first colored input point, a second colored input points, and a third colored input point, and the target subpixels have at least a first colored subpixel, a second colored subpixel, and a third colored subpixel, wherein a first row of the target subpixels and a second row of the target subpixels are non-aligned in a vertical direction, wherein the display control circuit comprises:

a subpixel rendering circuit, configured to map a first row of the input points to the first row of the target subpixels, wherein a plurality of coordinates of the first row of the target subpixels are respectively equivalent to a plurality of coordinates of the first row of the input points, and map a second row of the input points to the second row of the target subpixels, wherein a plurality of coordinates of the first colored subpixels of the second row of the target subpixels are respectively equivalent to a plurality of coordinates of the first colored input points of the second row of the input points being shifted in a horizontal direction, and a plurality of coordinates of the second row of the second and the third colored subpixels of the target subpixels are respectively equivalent to a plurality of coordinates of the second and the third colored input points of the second row of the input points.

2. The display control circuit according to claim 1, wherein the subpixel rendering circuit is further configured to map a third row of the input points to a third row of the target subpixels, wherein a plurality of coordinates of the third row of the target subpixels are respectively equivalent to a plurality of coordinates of the third row of the input points.

3. The display control circuit according to claim 2, wherein the first row of the target subpixels and the third row of the target subpixels are aligned in the vertical direction.

4. A display control circuit, applied to transform a plurality of input points of an input image to a plurality of target subpixels of a display panel, wherein the input points have at least a first colored input point, a second colored input point, and a third colored input point, and the target subpixels have at least a first colored subpixel, a second colored subpixel, and a third colored subpixel, wherein the display control circuit:

a subpixel rendering circuit, configured to map a first input point among the input points to a first target subpixel among the target subpixels, wherein a coordinate of the first target subpixel is equivalent to a coordinate of the first input point, and map a second input point among the input points to a second target subpixel among the target subpixels, wherein a coordinate of the first colored subpixel of the second target subpixel is equivalent to a coordinate of the first colored input point of the second input point with a coordinate shift, and coordinates of the second and the third colored subpixels of the second target subpixel are respectively equivalent to coordinates of the second and the third colored input points of the second input point.

5. The display control circuit according to claim 4, wherein the first input point and the second input point are respectively located at a first row and a second row of the input image.

6. The display control circuit according to claim 4, wherein the first target subpixel and the second target subpixel are respectively located at a first row and a second row of the display panel.

7. The display control circuit according to claim 4, wherein the coordinate shift is in a first direction.

8. The display control circuit according to claim 7, wherein the first target subpixel and the second target subpixel are arranged along a second direction, and the first direction and the second direction are perpendicular.

9. The display control circuit according to claim 7, wherein the first target subpixel and the second target subpixel are arranged along the first direction.

* * * * *